US005230653A

United States Patent [19]

Shinozaki et al.

[11] Patent Number: 5,230,653

[45] Date of Patent: Jul. 27, 1993

[54] CURRENCY SORTING APPARATUS

[75] Inventors: Takashi Shinozaki, Kashiwa; Hiroshi Tachikawa, Kasukabe, both of Japan

[73] Assignee: Laurel Bank Machines Co., Ltd., Tokyo, Japan

[21] Appl. No.: 864,422

[22] Filed: Apr. 6, 1992

[30] Foreign Application Priority Data

Apr. 10, 1991 [JP] Japan ..... 3-104799
Apr. 10, 1991 [JP] Japan ..... 3-104800
Mar. 30, 1992 [JP] Japan ..... 4-74274

[51] Int. Cl.[5] ..... G07D 3/14

[52] U.S. Cl. ..... 453/4; 271/298; 453/17

[58] Field of Search ..... 453/3, 4, 7, 11, 16, 453/17, 56; 271/298; 209/534; 194/206, 207; 235/379

[56] References Cited

U.S. PATENT DOCUMENTS 4,787,518 11/1988 Yuge et al. ..... 271/298 X
4,881,918 11/1989 Goh et al. ..... 453/4
4,917,792 4/1990 Murakami ..... 209/534
5,135,433 8/1992 Watanabe et al. ..... 453/3

FOREIGN PATENT DOCUMENTS 0386554 9/1990 European Pat. Off. ..... 453/3
61-115272 7/1986 Japan .
2-7186 1/1990 Japan .

*Primary Examiner*—F. J. Bartuska
*Attorney, Agent, or Firm*—Keck, Mahin & Cate

[57] ABSTRACT

A currency sorting apparatus including a detector provided in a currency passage for detecting information necessary for discriminating the genuineness and the denominations of pieces of currency and outputting detection signals, a plurality of currency accommodating boxes provided downstream of the detector, the number of which is greater than the number of denominations of the pieces of currency to be sorted, each of the currency accommodating boxes being adapted for accommodating genuine pieces of currency in accordance with their denominations, a controller adapted for selectively feeding pieces of currency into the currency accommodating boxes in accordance with the detection signals input from the detector and a sorting mode selector for selecting a sorting mode which determines what currency accommodating boxes accommodates what denomination of pieces of currency and outputs a corresponding sorting mode signal when the sorting mode is selected.

12 Claims, 17 Drawing Sheets

| |
|---|
| FIG. 7A |
| FIG. 7B |
| FIG. 7C |
| FIG. 7D |

CURRENCY SORTING APPARATUS

BACKGROUND OF THE INVENTION

The present invention relates to a currency sorting apparatus and, particularly, to such an apparatus which can efficiently sort currency.

DESCRIPTION OF THE PRIOR ART

A currency handling machine capable of receiving currency is provided with a currency sorting apparatus adapted for sorting out counterfeit pieces of currency from pieces of currency deposited into the machine and sorting pieces of the genuine currency in accordance with their denominations.

Japanese Utility Model Application Disclosure No. Sho 61-115272 discloses a coin sorting apparatus which has a coin transporting passage formed with a plurality of holes in such order that a first hole has diameter into which only the smallest coins can fall, a second hole has diameter into which the second smallest coins can fall but the third smallest coins cannot fall and that a third hole has diameter into which the third smallest coins can fall but the fourth smallest coins cannot fall and which sorts coins by dropping them into the holes in order starting from the smaller coins.

Further, Japanese Patent Application Disclosure No. Hei 1-7186 discloses a bill sorting apparatus which discriminates denominations of deposited bills or bank notes (collectively referred to as "bills" in this specification), sorts them based on the result of the discrimination in accordance with their denominations and accommodates them in bill accommodating boxes.

However, in the above mentioned coin sorting apparatus, since the coins are sorted by dropping them into a plurality of holes provided in the coin transporting passage in order starting from the smaller coins, it is extremely difficult to arbitrarily determine the positions and sizes of coin accommodating boxes for accommodating coins sorted in accordance with their denominations. As a result, if coins deposited into the coin handling machine include a lot of coins of a specific denomination, it becomes impossible for the coin accommodating box for accommodating the coins of that denomination to accommodate all of the coins and the sorting operation has to be stopped, preventing the apparatus from efficiently sorting coins.

Further, in the above mentioned bill sorting apparatus, since the denomination of the bills to be accommodated in each bill accommodating box is predetermined, if bills deposited into the bill handling machine include a lot of bills of a specific denomination, it becomes impossible for the bill accommodating box for accommodating bills of that denomination to accommodate all of the bills and the sorting operation has to be stopped, preventing the apparatus from efficiently sorting bills.

SUMMARY OF THE INVENTION

It is, therefore, an object of the present invention to provide a currency sorting apparatus which can efficiently sort pieces of currency such as coins or bills even when the pieces of currency deposited into the currency handling machine include a lot of pieces of currency of a specific denomination.

The above and other objects of the present invention can be accomplished by a currency sorting apparatus comprising currency feed-out means for receiving pieces of currency and feeding out the pieces of currency to a currency passage one by one, transporting means provided in the currency passage for transporting the pieces of currency fed to the currency passage, currency detecting means provided in the currency passage for detecting information necessary for discriminating at least whether the pieces of currency are acceptable and the denominations of the pieces of currency and outputting detection signals, a plurality of currency accommodating means provided in the currency passage downstream of the currency detecting means, the number of which is greater than the number of denominations of the pieces of currency to be sorted, each of the currency accommodating means being adapted for accommodating acceptable pieces of currency in accordance with their denominations, a plurality of currency distributing means, each being provided so as to correspond to one of the plurality of currency accommodating means and adapted for feeding the pieces of currency into the corresponding currency accommodating means, control means adapted for selectively driving the currency distributing means in accordance with the detection signals input from the currency detecting means and sorting mode selection means which can be operated by an operator for selecting a sorting mode which determines what currency accommodating means accommodates what denomination of pieces of currency and outputs a corresponding sorting mode signal when the sorting mode is selected, the currency sorting apparatus being constituted so that in the case where a first automatic sorting mode is selected in the sorting mode selection means, the control means judges based on the detection signals from the currency detecting means whether or not one of the currency accommodating means has accommodated a piece of currency of the same denomination as that of the piece of currency to be sorted and when it judges that there is a currency accommodating means which has accommodated the piece of currency of the same denomination as that of the piece of currency to be sorted, it selectively drives the corresponding currency distributing means so as to accommodate the piece of currency in the currency accommodating means which has accommodated the piece of currency of the same denomination as that of the piece of currency to be sorted, whereas it selectively drives the currency distributing means corresponding to the currency accommodating means which has not accommodated any currency so as to accommodate the currency therein when there is no currency accommodating means which has accommodated a piece of currency of the same denomination as that of the piece of currency to be sorted, and when the number of pieces of currency accommodated in one of the currency accommodating means has reached a predetermined number, it selectively drives the currency distributing means corresponding to the currency accommodating means which has not accommodated any piece of currency so as to accommodate the piece of currency the denomination of which is the same as that of the piece of currency accommodated in the currency accommodating means in which the number of pieces of currency has reached the predetermined number in the currency accommodating means which has not accommodated any piece of currency.

In a preferred aspect of the present invention, the currency detecting means is adapted for detecting information necessary for discriminating whether pieces of currency are acceptable, the denominations and damage levels of pieces of currency and outputting the detection signal and the currency accommodating means are provided so that the number thereof is greater than the number of denominations of the pieces of currency to be sorted by two or more and in the case where a second sorting mode is selected in the sorting mode selection means, the control means judges based on the detection signals from the currency detecting means whether or not the damage level of the piece of currency is lower than a predetermined level and when it judges that the damage level of the piece of currency is not lower than the predetermined level, it selectively drives a currency distributing means corresponding to a particular currency accommodating means among the plurality of the currency accommodating means so as to accommodate the piece of currency the damage level of which is judged not lower than the predetermined level in the particular currency accommodating means, and when the control means judges that the damage level of the piece of currency is lower than the predetermined level, it judges whether or not one of the currency accommodating means has accommodated a piece of currency of the same denomination as that of the piece of currency to be sorted and when it judges that there is a currency accommodating means which has accommodated a piece of currency of the same denomination as that of the piece of currency to be sorted, it selectively drives the corresponding currency distributing means so as to accommodate the piece of currency in the currency accommodating means which has accommodated the piece of currency of the same denomination as that of the piece of currency to be sorted, whereas it selectively drives the currency distributing means corresponding to the currency accommodating means which has not accommodated any piece of currency so as to accommodate the piece of currency therein when there is no currency accommodating means which has accommodated a piece of currency of the same denomination as that of the piece of currency to be sorted, and when the number of pieces of currency accommodated in one of the currency accommodating means has reached a predetermined number, it selectively drives the currency distributing means corresponding to the currency accommodating means which has not accommodated any pieces of currency so as to accommodate the piece of currency the denomination of which is the same as that of the pieces of currency accommodated in the currency accommodating means in which the number of pieces of currency has reached the predetermined number in the currency accommodating means which has not accommodated any piece of currency.

In another preferred aspect of the present invention, the currency sorting apparatus further comprises a damaged currency accommodating means for accommodating damaged pieces of currency the damage level of which is not lower than a predetermined level, a damaged currency distributing means for feeding the damaged pieces of currency into the damaged currency accommodating means and a currency detecting means adapted for detecting information necessary for discriminating whether pieces of currency are acceptable, the denominations of pieces of currency and damage levels and outputting a detection signal and in the case where a second sorting mode is selected in the sorting mode selection means, the control means judges based on the detection signals from the currency detecting means whether or not the damage level of the piece of currency is lower than a predetermined level and when it judges that the damage level of the piece of currency is not lower than the predetermined level, it selectively drives the damaged currency distributing means so as to accommodate the damaged piece of currency in the damaged currency accommodating means.

In a further preferred aspect of the present invention, the currency sorting apparatus further comprises an unacceptable currency accommodating means for accommodating unacceptable pieces of currency and a unacceptable currency distributing means for feeding the unacceptable pieces of currency into the unacceptable currency accommodating means and the control means is constituted so that when it judges based on the detection signal from the currency detecting means that the piece of currency is unacceptable, it selectively drives the unacceptable currency distributing means thereby accommodating the unacceptable piece of currency in the unacceptable currency accommodating means.

In a further preferred aspect of the present invention, the pieces of currency are coins and each of the plurality of currency accommodating means comprises a coin dropping opening which opens the currency passage and a coin accommodating box communicating with the coin dropping opening and each of the plurality of currency distributing means comprises a rotor supported below the currency passage to be rotatable about a shaft arranged parallel to a surface of the currency passage and perpendicular to a direction of the currency passage and having a large diameter portion and a small diameter portion and a rotor drive means for rotating the rotor, the rotor being held so that the level of the top portion of the large diameter portion is substantially flush with the level of the currency passage surface when the control means is not actuating the currency distributing means, whereas the rotor is rotated by the rotor drive means so that the level of the top portion of the large diameter portion is lower than the level of the currency passage surface when the control means is actuating the currency distributing means. The fact that the rotor being held so that the level of the to portion of the large diameter portion is substantially flush with the level of the currency passage surface means that the level of the top portion of the large diameter portion of the rotor is held so that a coin being transported in the currency passage cannot fall into the coin dropping opening corresponding to the rotor but can pass the coin dropping opening. The fact that the rotor is rotated by the rotor drive means so that the level of the top portion of the large diameter portion is lower than the level of the currency passage surface means that the rotor is rotated so that the level of the top portion of the large diameter portion of the rotor is lowered enough for allowing the coin being transported in the coin passage to drop in the coin dropping opening corresponding to the rotor along the side surface of the rotor.

The above and other objects and features of the present invention will become apparent from the following description made with reference to the accompanying drawings.

DESCRIPTION OF THE PREFERRED EMBODIMENT

Figure 1:
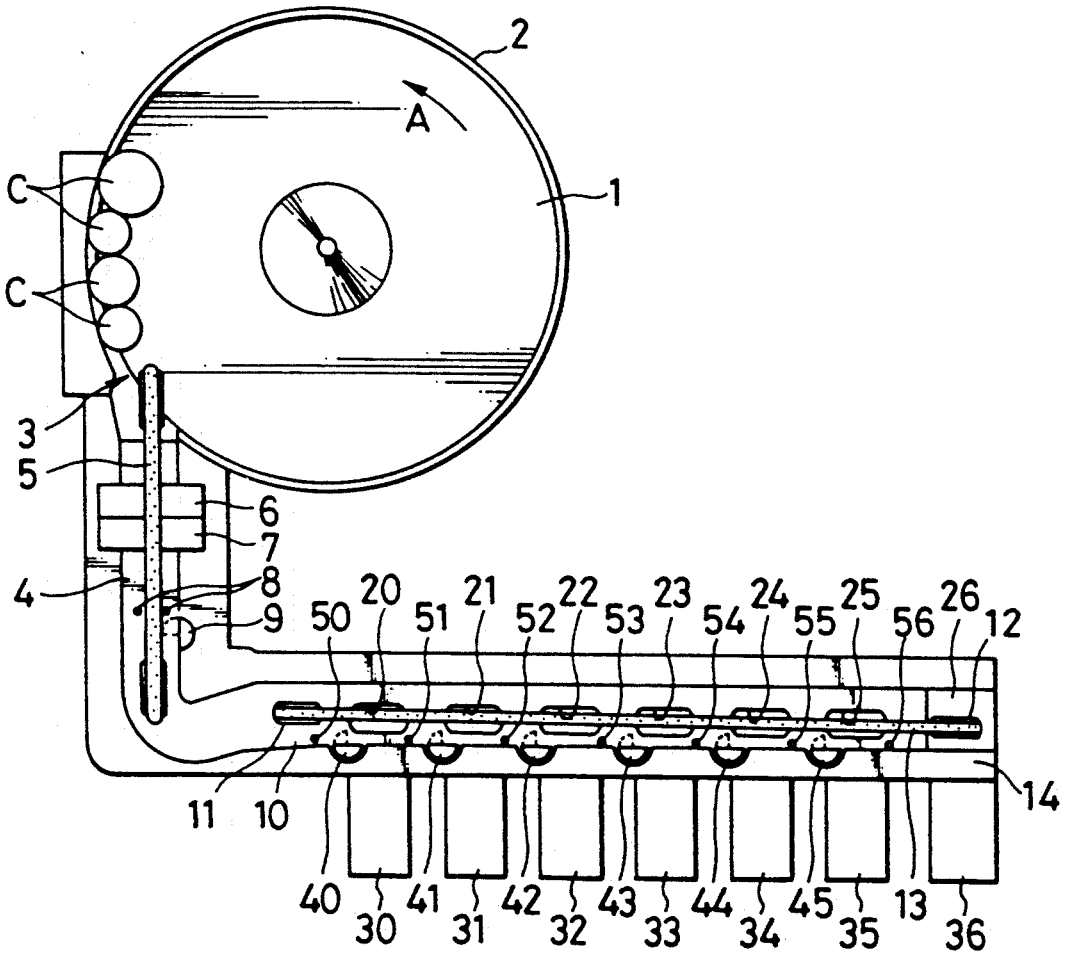
FIG. 1 is a schematic drawing showing a plan view of a coin receiving machine including a coin sorting apparatus which is an embodiment of the present invention.

Referring to FIG. 1, a coin receiving machine comprises a rotary disk 1 onto which coins C deposited into the coin receiving machine are fed and which is rotated by a motor (not shown), and a guide wall 2 arranged along the periphery of the rotary disk 1. The guide wall 2 is formed with an opening 3 to which a coin passage 4 is connected in the tangential direction of the rotary disk 1. Coins C fed onto the rotary disk 1 are transported along the inner wall surface of the guide wall 2 by the centrifugal force produced by the rotation of the rotary disk 1 and fed into the coin passage 4. The coins C fed into the coin passage 4 are held between a transporting belt 5 provided in the coin passage 4 and formed by an endless belt and the upper surface of the coin passage and transported downstream in the coin passage 4.

In the coin passage 4, there are provided a magnetic sensor 6 for magnetically detecting the material of coins C and an optical sensor 7 for optically detecting the diameter of coins C, and detection signals of the magnetic sensor 6 and the optical sensor 7 are output to a CPU explained later. The CPU judges based on the detection signals input from the magnetic sensor 6 and the optical sensor 7 whether coins C are genuine or counterfeit, the denominations of coins C and whether or not coins are damaged and causes a memory means to store the result of the judgment.

Downstream of the magnetic sensor 6 and the optical sensor 7 in the coin passage 4, a coin sensor 8 for detecting coins C is provided and a semicylindrical stopper 9 is arranged outside of the coin passage 4 downstream of the coin sensor 8 so as to be rotatable about a vertical shaft by a solenoid (not shown). When the coins C are being transported, as indicated by a solid line in FIG. 1, the stopper 9 is positioned so that its flat side surface is aligned with the inner wall of the coin passage 4. On the other hand, when the transportation of the coins C is stopped, in accordance with signals from the CPU and the coin sensor 8, the stopper 9 is rotated by the solenoid as indicated by a dotted line in FIG. 1 and a part thereof projects into the coin passage 4, thereby to stop the coins C. The coin sensor is adapted for determining timing for rotating the stopper 9 in the case where a predetermined number of coins C have been fed downstream and the transportation of coins C is stopped or other cases.

At the downstream end of the coin passage 4, a coin sorting passage 10 is connected to the coin passage 4 substantially perpendicular thereto and the coins C are fed from the coin passage 4 to the coin sorting passage 10.

In the coin sorting passage 10, there is provided a transporting belt 13 consisting of an endless belt wound around a pulley 11 and a pulley 12 which is adapted for holding the coins between itself and the upper surface of the coin sorting passage 10 and transporting them along a reference guide wall 14 in the coin sorting passage 10. Although not shown in FIG. 1, the transporting belt 13 is provided with a plurality of press rollers for pressing itself against the upper surface of the coin sorting passage 10.

Further, the coin sorting passage 10 is formed with an unacceptable coin collecting opening 20 for collecting unacceptable coins such as counterfeit coins, foreign coins and the like, a first sorting opening 21, a second sorting opening 22, a third sorting opening 23, a fourth sorting opening 24, a fifth sorting opening 25 and a coin collecting opening 26. The length of the unacceptable coin collecting opening 20, the first sorting opening 21, the second sorting opening 22, the third sorting opening 23, the fourth sorting opening 24 and the fifth sorting opening 25 are formed smaller than the smallest coin C to be handled in the widthwise direction of the coin sorting passage 10 and the coin collecting opening 26 is formed large enough for dropping the largest coins to be handled. The unacceptable coin collecting opening 20, the first sorting opening 21, the second sorting opening 22, the third sorting opening 23, the fourth sorting opening 24, the fifth sorting opening 25 and the coin collecting opening 26 respectively communicate with an unacceptable coin collecting box 30, a first sorting box 31, a second sorting box .32, a third sorting box 33, a fourth sorting box 34, a fifth sorting box 35 and a coin collecting box 36.

An unacceptable coin collecting means 40, a first sorting means 41, a second sorting means 42, a third sorting means 43, a fourth sorting means 44 and a fifth sorting means 45, each being formed semicylindrical, are arranged in the reference guide wall 14 of the coin sorting passage 10. Each of the unacceptable coin collecting means 40, the first sorting means 41, the second sorting means 42, the third sorting means 43, the fourth sorting means 44 and the fifth sorting means 45 is rotatable by a solenoid (not shown) and is normally positioned, as indicated by a solid line in FIG. 1, so that its flat side surface is aligned with the inner surface of the reference guide wall 14 of the coin sorting passage 10. On the other hand, when the coins C are fed into the corresponding unacceptable coin collecting opening 20, first sorting opening 21, second sorting opening 22, third sorting opening 23, fourth sorting opening 24 or fifth sorting opening 25, each of the unacceptable coin collecting means 40, the first sorting means 41, the second sorting means 42, the third sorting means 43, the fourth sorting means 44 and the fifth sorting means 45 is rotated by a solenoid as indicated by a dotted line in FIG. 1 so as to project into the coin sorting passage 10 from the reference guide wall 14.

Further, in the coin sorting passage 10 immediately upstream of the unacceptable coin collecting means 40, the first sorting means 41, the second sorting means 42, the third sorting means 43, the fourth sorting means 44 and the fifth sorting means 45, an unacceptable coin sensor 50 for detecting unacceptable coins such as counterfeit coins, foreign coins and the like, a first sensor 51, a second sensor 52, a third sensor 53, a fourth sensor 54 and a fifth sensor 55 are provided, each of the first to fifth sensors being adapted for detecting coins C of a specified denomination, and a sixth sensor 56 is provided in the coin sorting passage 10 downstream of the fifth sorting opening 25 and upstream of the coin collecting opening 26.

When the CPU judges that the unacceptable coin sensor 50 has detected an unacceptable coin such as counterfeit coin, foreign coin or the like, the unacceptable coin collecting means 40 is rotated by a solenoid (not shown) in accordance with signals from the CPU and the unacceptable coin sensor 50 and projected into the coin sorting passage 10 from the reference guide wall 14. As a result, the unacceptable coin is pushed away from the reference guide wall 14 and dropped in the unacceptable coin collecting opening 20. Thus the unacceptable coin is collected in the unacceptable coin collecting box 30 via the unacceptable coin collecting opening 20.

Further, when the CPU judges that the first sensor 51, the second sensor 52, the third sensor 53, the fourth sensor 54 or the fifth sensor 55 has detected a coin of a specific denomination, the first sorting means 41, the second sorting means 42, the third sorting means 43, the fourth sorting means 44 or the fifth sorting means 45 is rotated by the solenoid (not shown) in accordance with signals from the CPU and the corresponding first sensor 51, second sensor 52, third sensor 53, fourth sensor 54 or fifth sensor 55 and is projected into the coin sorting passage 10 from the reference guide wall 14. As a result, the coin having the specific denomination and transported in the coin sorting passage 10 is dropped in the corresponding first sorting opening 21, second sorting opening 22, third sorting opening 23, fourth sorting opening 24 or fifth sorting opening 25 to be sorted in accordance with its denomination. Thus the coins are fed into the first sorting box 31, the second sorting box 32, the third sorting box 33, the fourth sorting box 34 and the fifth sorting box 35 via the first sorting opening 21, the second sorting opening 22, the third sorting opening 23, the fourth sorting opening 24 and the fifth sorting opening 25 and are thus sorted in accordance with their denominations.

The coin collecting opening is adapted for collecting coins C of the denomination other than the denominations of the coins dropped in any of the unacceptable coin collecting opening 30, the first sorting opening 21, the second sorting opening 22, the third sorting opening 23, the fourth sorting opening 24 and the fifth sorting opening 25, and the sixth sensor 56 is adapted for detecting coins C to be collected in the coin collecting opening 26.

Figure 2:
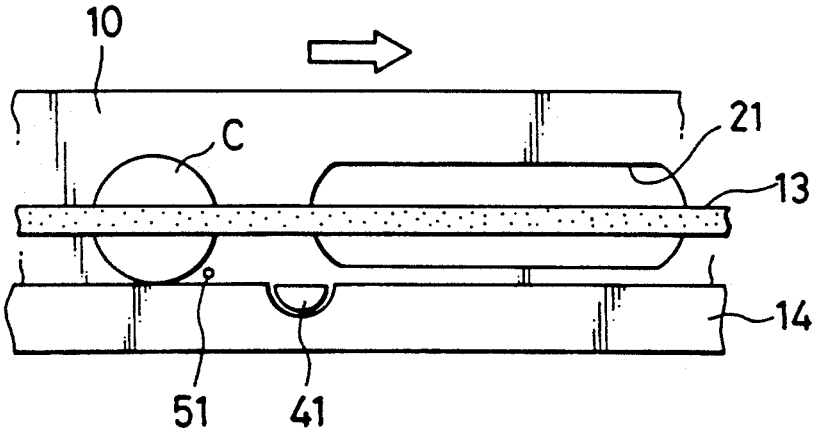
FIG. 2 is a schematic plan view showing a coin being transported immediately before a first sensor.
Figure 3:
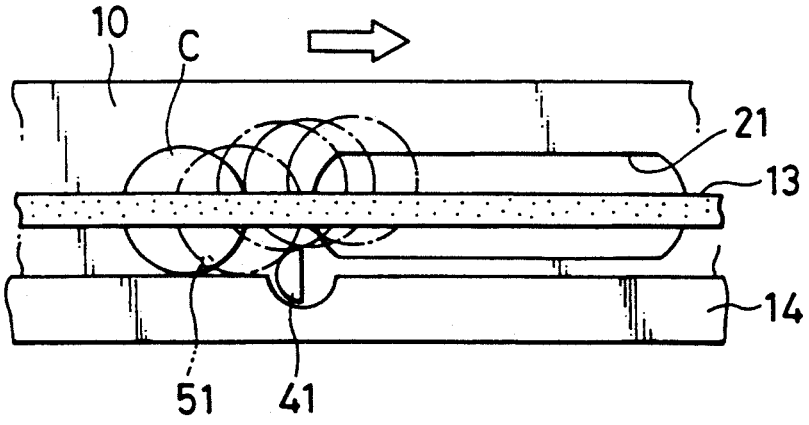
FIG. 3 is a schematic plan view showing a coin being fed to a first sorting opening by a first sorting means after it was detected by a first sensor.
Figure 4:
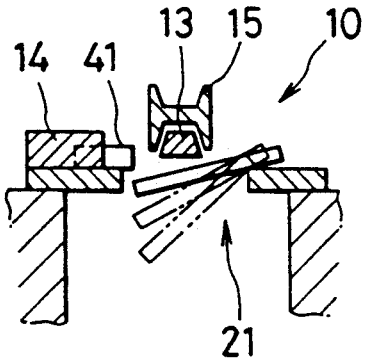
FIG. 4 is a schematic lateral cross-sectional view showing a coin falling into a first sorting opening.
Figure 5:
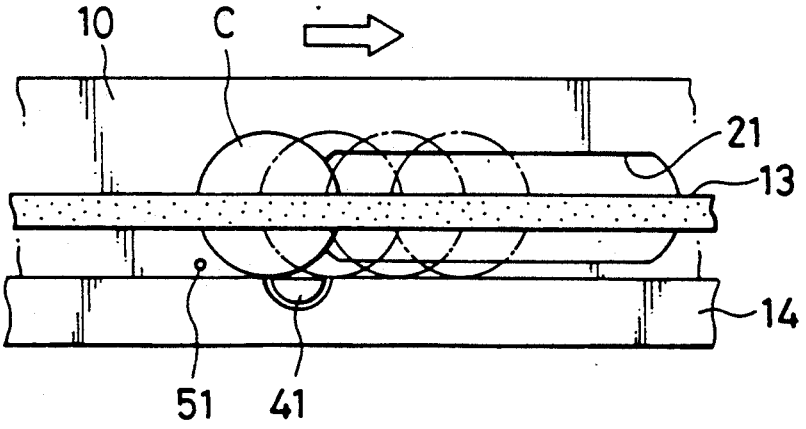
FIG. 5 is a schematic plan view showing a coin passing on a first sorting opening after it was detected by a first sensor.

FIG. 2 is a schematic plan view showing a coin being transported immediately before the first sensor 51. FIG. 3 is a schematic plan view showing a coin being fed to the first sorting opening 21 by the first sorting means 41 after it was detected by a first sensor. FIG. 4 is a schematic lateral cross-sectional view showing a coin falling into the first sorting opening 21. FIG. 5 is a schematic plan view showing a coin passing on the first sorting opening 21 after it was detected by the first sensor 51.

Referring to FIG. 2, when no coin C is detected by the first sensor 51, the first sorting means 41 is positioned so that its flat side surface is aligned with the inner wall of the reference guide wall 14 of the coin sorting passage 10.

Referring to FIG. 3, when the first sensor 51 detects a coin C, it outputs a detection signal to the CPU. When the CPU receives the detection signal from the first sensor 51, it reads out data from a memory means and judges whether or not the detected coin C was decided for sorting by dropping it into the first sorting opening 21. Then, if it was, the CPU outputs a drive signal to a solenoid (not shown), thereby rotating the first sorting means 41 clockwise by about 90 degree in FIG. 3 and projecting it from the reference guide wall 14 into the coin sorting passage 10. As a result, as indicated by a imaginary line in FIG. 3, the coin C is pushed away by the first sorting means 41 from the reference guide wall 14 toward the first sorting opening 21. Since the coin C is transported by being pressed against the upper surface of the coin sorting passage 10 with a predetermined pressure by the transporting belt 13, the coin C is reliably fed toward the first sorting opening 21 by the first sorting means 41 and, as shown in FIG. 4, falls into the first sorting opening 21 without fail, thereby being sorted into the first coin accommodating box 31 communicating with the first sorting opening 21. In FIG. 4, the reference numeral 14 designates a press roller for pressing the transporting belt 13 against the upper surface of the coin sorting passage 10.

The distance between the first sensor 51 and the first sorting means 41 is determined in accordance with the transporting speed of coins C in such a manner that after the first sensor 51 detects the coin C to be sorted by dropping it into the first sorting opening 21 and outputs the detection signal to the CPU and when the CPU outputs the drive signal to the solenoid based on the detection signal input from the first sensor 51 thereby to rotate the first sorting means 41, the coin C will be reliably dropped into the first sorting opening 21. Further, the first sensor 51 continues to output the detection signal to the CPU during time period it detects the coin C to be sorted by dropping it into the first sorting opening 21.

When a predetermined time period has passed during which no detection signal was input from the first sensor 51 to the CPU, in other words, when a predetermined time period has passed during which the first sensor 51 did not detect any coin C after the last coin C was dropped into the first sorting opening 21, the CPU outputs a return signal to the solenoid. As a result, the first sorting means 41 which has been rotated and projected into the coin sorting passage 10 for dropping the coin C into the first sorting opening 21 is rotated counterclockwise by about 90 degree and returned to the position shown in FIG. 2.

On the contrary, when the CPU judges based on the detection signals from the magnetic sensor 6 and the optical sensor 7 that the coin C detected by the first sensor 51 is not a coin C to be sorted by being dropped into the first sorting opening 21, the CPU outputs no drive signal to the solenoid even if the detection signal is input from the first sensor 51. As a result, as shown in FIG. 5, the first sorting means 41 is held so that its flat side surface is aligned with the inner surface of the reference guide wall 14 of the coin sorting passage 10 and since the first sorting opening 21 is formed so that its length in the widthwise direction of the coin sorting passage 10 is smaller than the diameter of the smallest coin C to be handled, the coin C passes on the first sorting opening 21 and is fed toward the second sensor 52.

Although only the first sorting means 41, the first sorting opening 21 and the first sensor 51 are shown in FIGS. 2 to 5, the unacceptable coin collecting means 40, the second sorting means 42, the third sorting means 43, the fourth sorting means 44, the fifth sorting means 45, the unacceptable coin collecting opening 20, the second sorting opening 22, the third sorting opening 23, the fourth sorting opening 24, the fifth sorting opening 25, the unacceptable coin sensor 50, the first sensor 51, the second sensor 52, the third sensor 53, the fourth sensor 54 and the fifth sensor 55 are similarly constituted.

Figure 6:
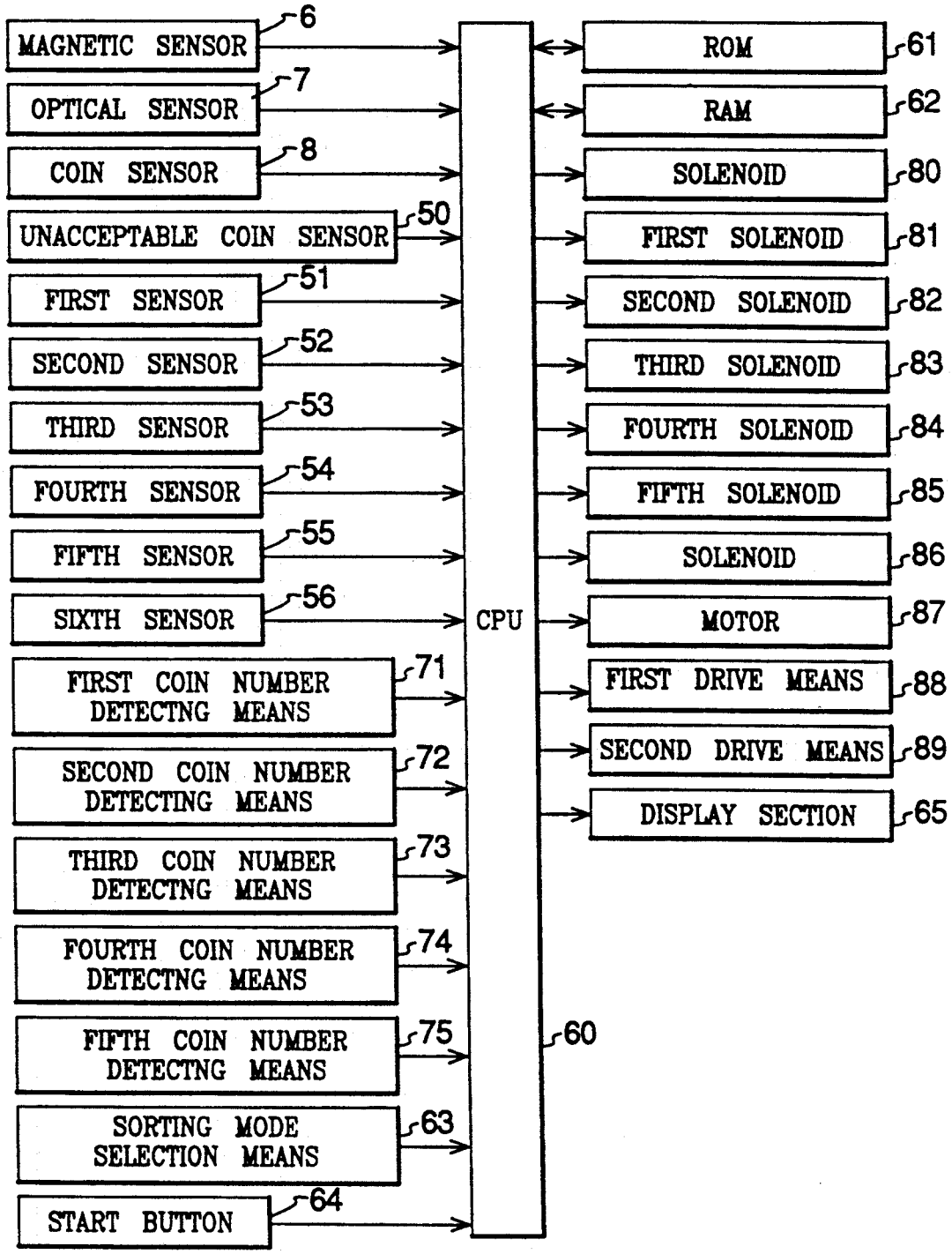
FIG. 6 is a block diagram showing a coin sorting apparatus which is an embodiment of the present invention.

FIG. 6 is a block diagram showing a coin sorting apparatus which is an embodiment of the present invention.

Referring to FIG. 6, the coin sorting apparatus comprises a CPU 60 as a control means and a ROM 61 for storing control programs for the CPU 60 and reference data and a RAM 62 for storing various data are connected to the CPU 60. The CPU 60 is adapted for receiving the detection signals from the magnetic sensor 6 and the optical sensor 7 and the detection signals from the coin sensor 8, the unacceptable coin sensor 50, the first sensor 52, the third sensor 53, the fourth sensor 54, the fifth sensor 55 and the sixth sensor 56. Further, a first coin number detecting means 71, a second coin number detecting means 72, a third coin number detecting means 73, a fourth coin number detecting means 74 and a fifth coin number detecting means 75 are respectively associated with the first coin accommodating box 31, the second coin accommodating box 32, the third coin accommodating box 33, the fourth coin accommodating box 34 and the fifth coin accommodating box 35 for judging whether or not the number N of coins C accommodated therein has reached a predetermined number $N_0$ and are adapted for outputting an accommodation stop signal to the CPU when the number of coins C accommodated therein has reached the predetermined number $N_0$. As the first coin number detecting means 71, the second coin number detecting means 72, the third coin number detecting means 73, the fourth coin number detecting means 74 and the fifth coin number detecting means 75, there can, for example, be used a photosensor consisting of a light emitting element and a light receiving element. Further, the predetermined number $N_0$ is set slightly smaller than the maximum number Nmax of coins C which the first coin accommodating box 31, the second coin accommodating box 32, the third coin accommodating box 33, the fourth coin accommodating box 34 or the fifth coin accommodating box 35 can accommodate. Moreover, the CPU 60 is adapted for receiving sorting mode signals from a sorting mode selection means 63 provided in an operation section (not shown) of the coin receiving machine and adapted for being operated by an operator. By using the sorting mode selection means 63, the operator can specify what coin accommodating box 31, 32, 33, 34, 35 should accommodate what denomination of coins C or can allow the coin sorting apparatus to automatically determine what denominations of coins C should be accommodated in what coin accommodating box 31, 32, 33, 34, 35 by selecting a first sorting mode. Further, by selecting a second sorting mode, the operator can cause the coin sorting apparatus to discriminate the damage level of coins C, can allow it to automatically determine what denomination of coins C of lower than a predetermined damage level should be accommodated in what coin accommodating box 31, 32, 33, 34, 35 and can cause it to accommodate the coins C whose damage level is not lower than the predetermined level in the coin collecting box 36 communicating with the sixth sorting opening 26. Moreover, when a start button 64 for causing the coin receiving operation to start is operated, the CPU 60 is adapted for receiving a start signal from the start button 64.

Based on these input signals, the CPU 60 outputs drive signals to a solenoid 80 for driving the unacceptable coin collecting means 40, a first solenoid 81 for driving the first sorting means 41, a second solenoid 82 for driving the second sorting means 42, a third solenoid 83 for driving the third sorting means 43, a fourth solenoid 84 for driving the fourth sorting means 44, a fifth solenoid 85 for driving the fifth sorting means 45 and a solenoid 86 for driving the stopper 9, and outputs drive signals or drive stop signals to a motor 87 for rotating the rotary disk 1, a first drive means 88 for driving the transporting belt 5 and a second drive means 89 for driving the transporting belt 13. Further, the CPU 60 is adapted for outputting display signals to a display section for displaying the number and/or amount of the coins C accommodated in the unacceptable coin collecting box 30, each of the coin accommodating boxes 31, 32, 33, 34, 35 and the coin collecting box 36.

The CPU 60 judges based on the detection signals from the magnetic sensor 6 and the optical sensor 7 whether or not the coin C is acceptable, whether or not the damage level of the coin C is lower than the predetermined level and the denominations of the coin C and stores the results of these judgment in the RAM 62. Based on the result of the judgment, the CPU further judges in which of the unacceptable coin collecting box 30, the first sorting box 31, the second sorting box 32, the third sorting box 33, the fourth sorting box 34, the fifth sorting box 35 and the coin collecting box 36 the coin C should be accommodated and stores the result of this judgment in the RAM 62. Further, the CPU counts the number of coins C accommodated every time it makes a judgment as to in which box the coin C should be accommodated and causes counters provided in the RAM 62 to store how many coins C have been accommodated in the unacceptable coin collecting box 30, the first coin accommodating box 31, the second coin accommodating box 32, the third coin accommodating box 33, the fourth coin accommodating box 34, the fifth coin accommodating box 35 and the coin collecting box 36. Moreover, when the CPU receives an accommodation stop signal from the first coin number detecting means 71, the second coin number detecting means 72, the third coin number detecting means 73, the fourth coin number detecting means 74 or the fifth coin number detecting means 75, it stores in the RAM 62 information as to which of the first coin accommodating box 31, the second coin accommodating box 32, the third coin accommodating box 33, the fourth coin accommodating box 34 and the fifth coin accommodating box 35 cannot accommodate any more coins C. The unacceptable coin collecting box 30 and the coin collecting box 36 are not provided with any detecting means for detecting whether or not the number N of coins C accommodated therein has reached the predetermined number $N_0$. This is because the number of the coins C accommodated in the unacceptable coin collecting box 30 and the coin collecting box 36 is small and the number of coins C accommodated therein does not reach the predetermined number $N_0$ before the number of coins C accommodated in one of the first coin accommodating box 31, the second coin accommodating box 32, the third coin accommodating box 33, the fourth coin accommodating box 34 and the fifth coin accommodating box 35 has reached the predetermined number $N_0$.

Figures 7, 7A:
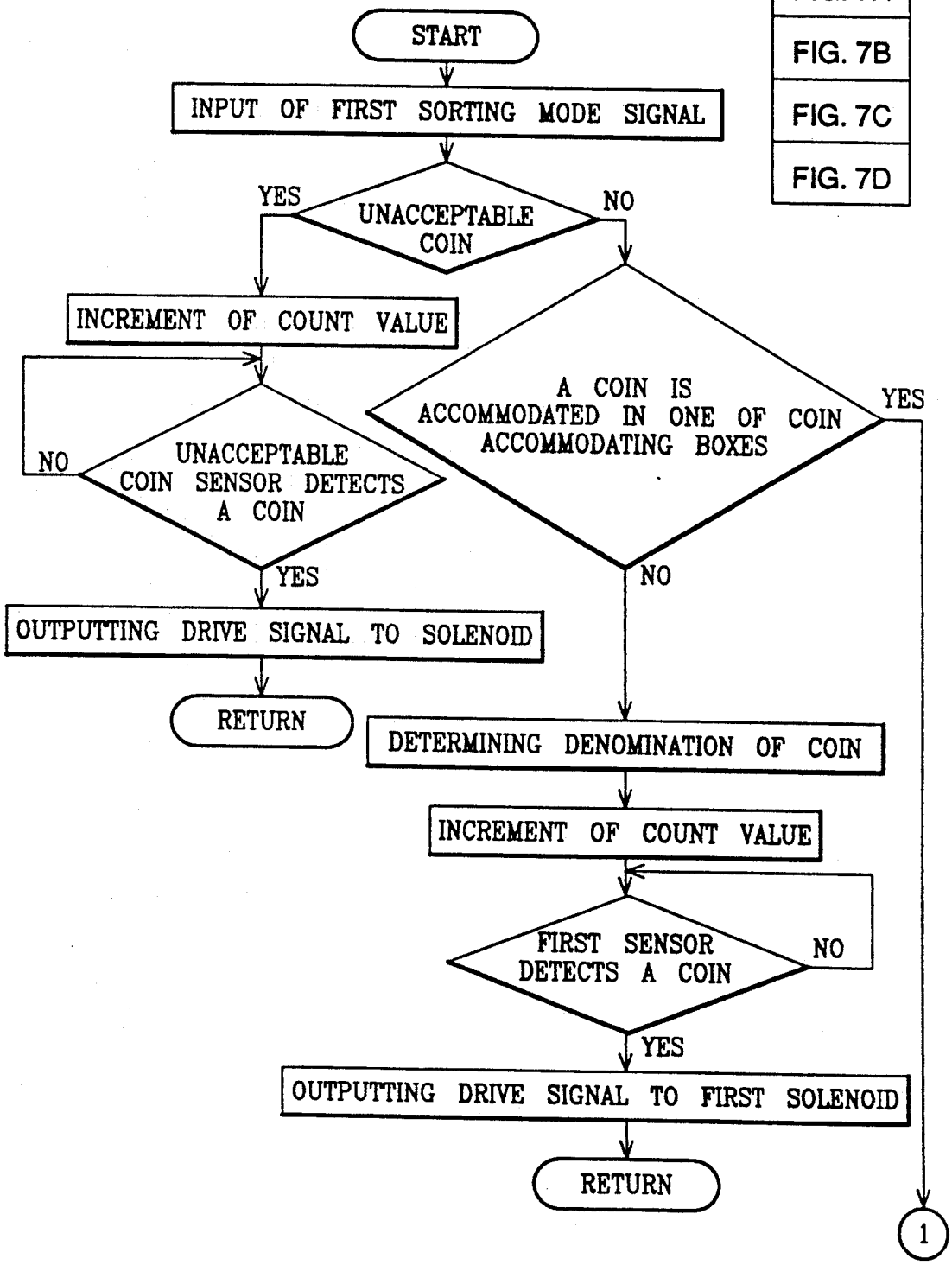
FIG. 7 is a chart showing the sequence of the flow charts of FIGS. 7A through 7D.
FIG. 7A is a flow chart showing a sorting operation effected by the coin sorting apparatus shown in FIGS. 1 to 6 when a first sorting mode is selected in a sorting mode selection means.
Figure 7B:
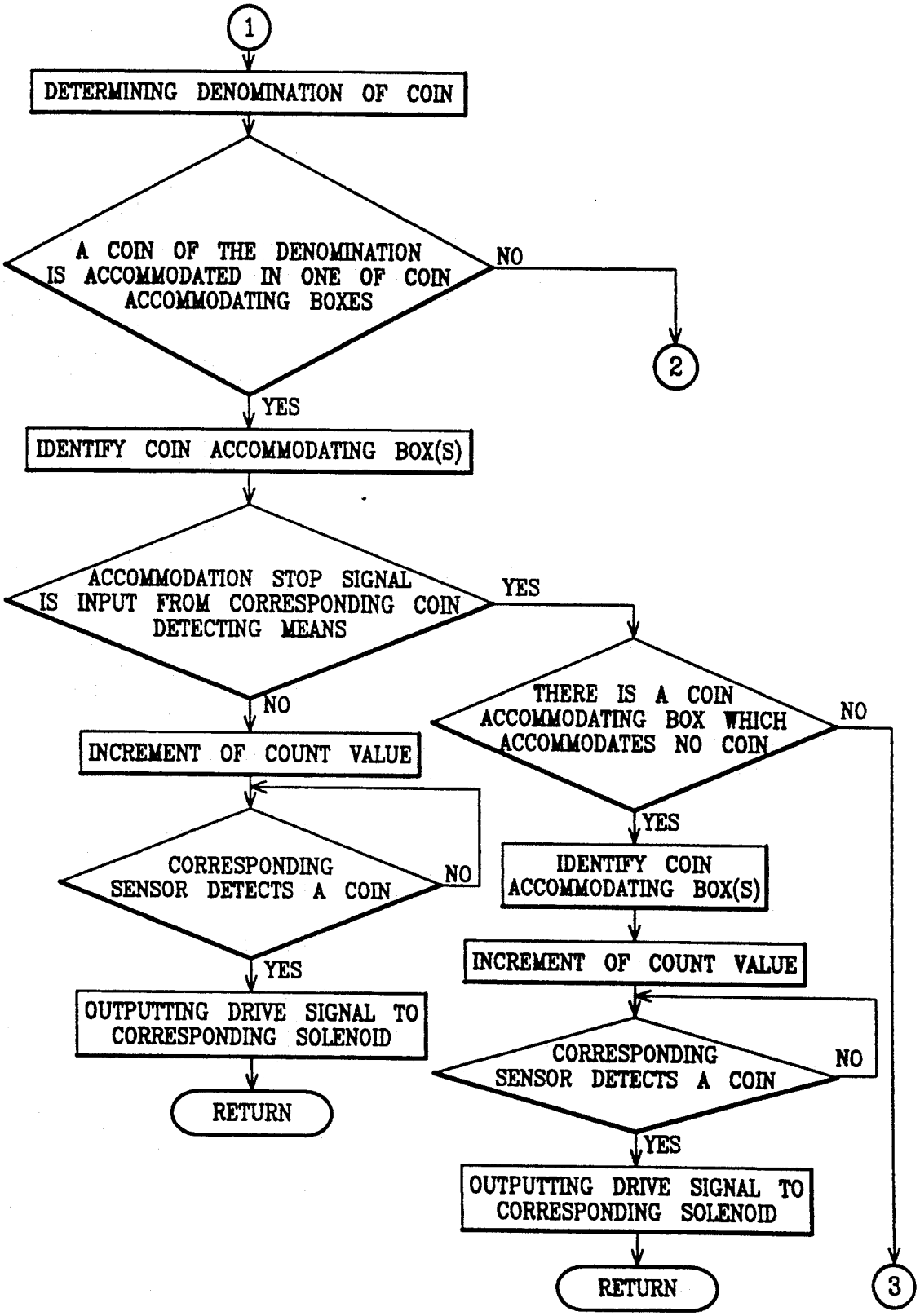
FIG. 7B is a continuation of the flow chart of FIG. 7A.
Figure 7C:
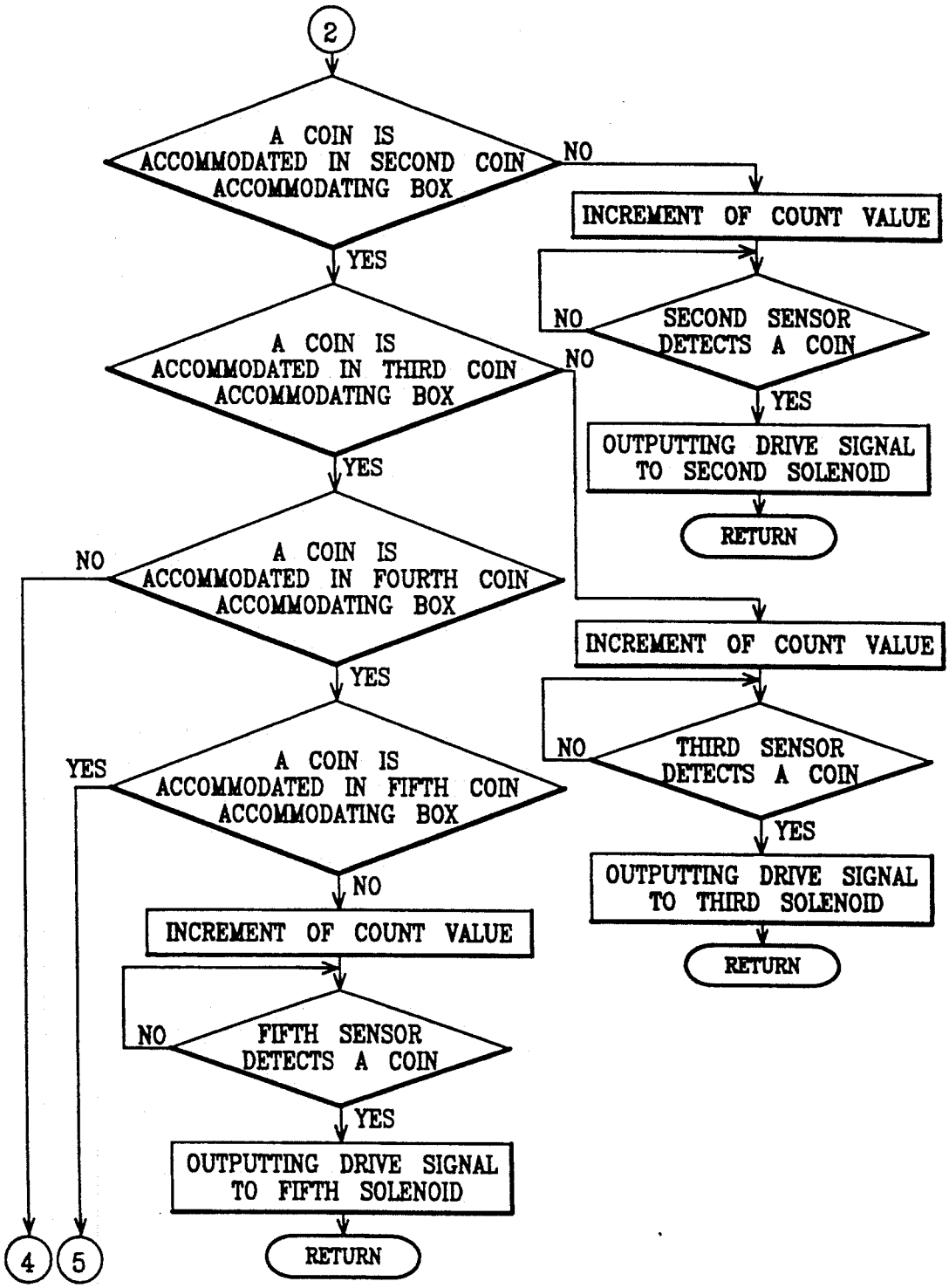
FIG. 7C is a continuation of the flow chart of FIG. 7B.
Figure 7D:
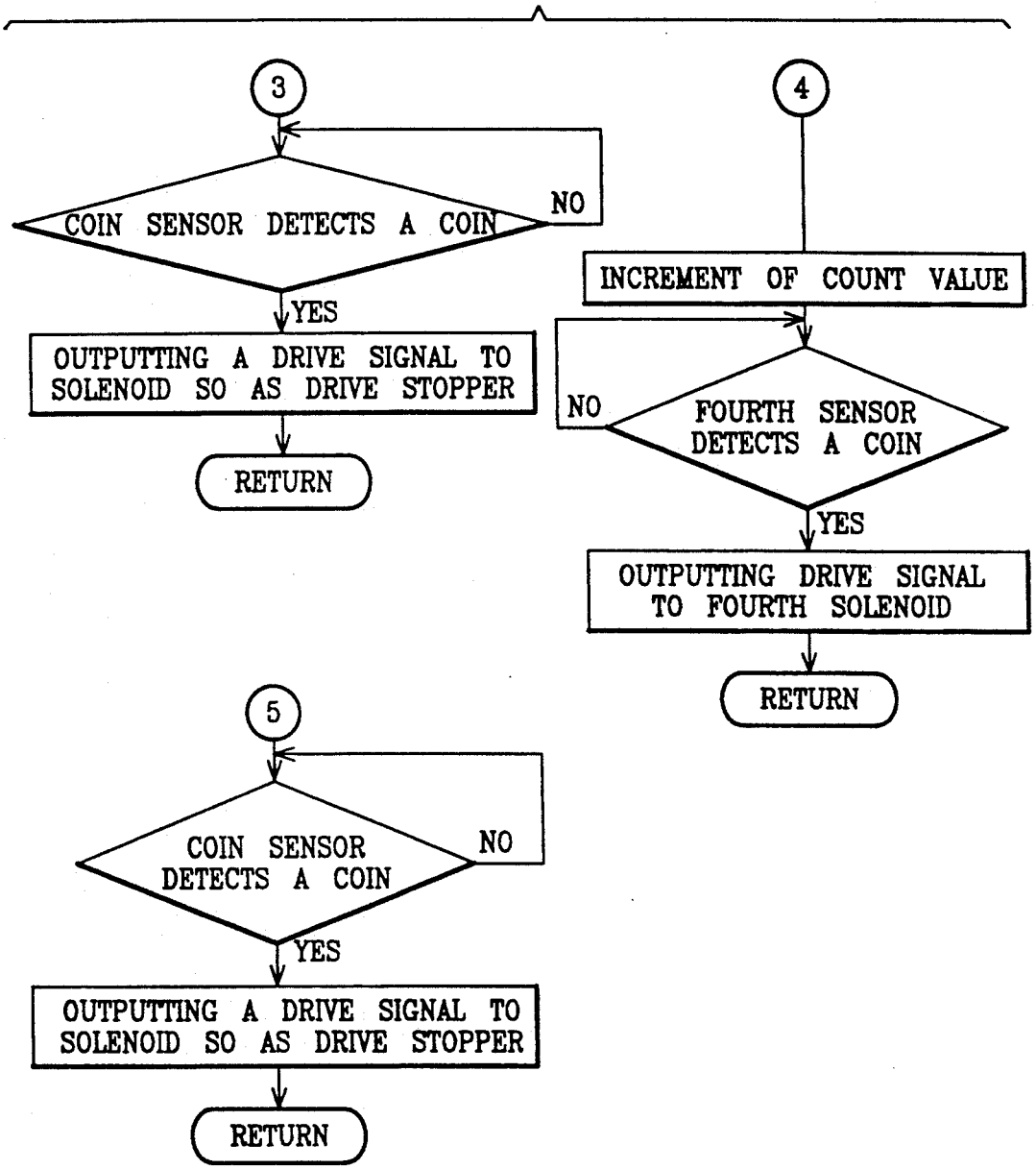
FIG. 7D is a continuation of the flow chart of FIG. 7C.

FIG. 7 is a flow chart relating to an embodiment of the thus constituted coin sorting apparatus in which four denominations of coins C are sorted and shows a sorting operation in the case where the first sorting mode is selected in the sorting mode selection means 63.

Referring to FIG. 7, when the operator operates the start button 64 and starts the coin receiving operation of the coin receiving machine, a start signal is input from the start button 64 into the CPU 60 and when the operator selects a first sorting mode, a first sorting mode signal is output from the sorting mode selection means 63 to the CPU 60.

When the CPU 60 receives the start signal, it outputs a drive signal to the motor 87, thereby rotating the rotary disk 1 and outputs drive signals to the first drive means 88 and the second drive means 89, thereby driving the transporting belt 5 and the transporting belt 13.

As a result, the coins C deposited into the coin receiving machine and fed onto the rotary disk 1 are fed to the opening 3 along the guide wall 2 by the centrifugal force produced by the rotation of the rotary disk 1 and further fed into the coin passage 4.

Each coin C fed into the coin passage 4 is held between the transporting belt 5 and the upper surface of the coin passage 4 and transported downstream in the coin passage 4 by the transporting belt 5. Then, the material of the coin C is detected by the magnetic sensor 6 and the diameter thereof is detected by the optical sensor 7, and the detection signals are output into the CPU 60.

The CPU 60 compares the detection signals from the magnetic sensor 6 and the optical sensor 7 with the reference data stored in the ROM 61, judges whether or not the coin C is acceptable and determines the denomination thereof. Then, it stores the result of this judgment in the RAM 62.

Simultaneously, when the CPU 60 judges that the coin C is an unacceptable coin such as counterfeit coin, foreign coin or the like, it judges that the coin C should be accommodated in the unacceptable coin collecting box 30. Then, the CPU 60 stores the result of this judgment in the RAM 62 and increments the count value of the counter provided in the RAM 62 for the unacceptable coin collecting box 30 by one.

On the contrary, when the CPU 60 judges that the coin C is acceptable, it reads out information stored in the RAM 62 and judges whether or not a coin is accommodated in any one of the first coin accommodating box 31, the second coin accommodating box 32, the third coin accommodating box 33, the fourth coin accommodating box 34 and the fifth coin accommodating box 35. When the result is NO, the CPU 60 judges that the coin C should be accommodated in the first coin accommodating box 31. Then it stores the result of this judgment in the RAM 62 and increments the count value of the counter provided in the RAM 62 for the first coin accommodating box 31 by one.

On the other hand, when the result is YES, the CPU 60 reads out information stored in the RAM 62 and judges whether or not there is a coin accommodating box which has accommodated a coin the denomination of which is the same as that of the coin C to be sorted.

When the CPU 60 judges that there is a coin accommodating box which has accommodated a coin C the denomination of which is the same as that of the coin C to be sorted, it judges in which of the first coin accommodating box 31, the second coin accommodating box 32, the third coin accommodating box 33, the fourth coin accommodating box 34 and the fifth coin accommodating box 35 the coin C the denomination of which is the same as that of the coin C to be sorted is accommodated. Further the CPU 60 judges whether or not an accommodation stop signal(s) has been input from the coin number detecting means associated with all of the coin accommodating box(es).

As a result, when no accommodation stop signal has been input from the coin number detecting means associated with the coin accommodating box(es) which has accommodated the coin C the denomination of which is the same as that of the coin C to be sorted, since the number N of coins C accommodated in the coin accommodating box has not reached the predetermined number $N_0$ yet and it is possible for the coin accommodating box to accommodate the coin C, the CPU 60 judges that the coin C should be accommodated in the coin accommodating box. Then, the CPU 60 stores the result of this judgment in the RAM 62 and increments the count value of the counter for the coin accommodating box by one.

On the other hand, when the accommodation stop signal has been input from the coin number detecting means associated with all of the coin accommodating box(es) which has accommodated the coin C the denomination of which is the same as that of the coin C to be sorted, since the coin accommodating box(es) cannot accommodate the coin C, the CPU 60 further judges whether or not there is any coin accommodating box which has not accommodated any coin C. When the result is YES, the CPU 60 judges that the coin C should be accommodated in the coin accommodating box. Then, the CPU 60 stores the result of this judgment in the RAM 62 and increments the count value of the counter for the coin accommodating box by one.

On the contrary, when the CPU 60 judges that there is no coin accommodating box which has not accommodated a coin C, since it is impossible to accommodate the coin C in any coin accommodating box and the sorting operation has to be stopped, the CPU 60 judges that a drive signal should be output to a solenoid 86 for driving the stopper 9 when the coin sensor 8 detects the coin C and a detection signal is input therefrom and the coin C should be prevented by the stopper 9 from being fed into the coin sorting passage 10 and stores the result of this judgment in the RAM 62.

On the contrary, when the CPU 60 judges that although at least one of the coin accommodating boxes has accommodated a coin C, there is no coin accommodating box which has accommodated a coin C the denomination of which is the same as that of the coin C to be sorted, since an acceptable coin C is first accommodated in the first coin accommodating box 31, it can be considered that a coin C of different denomination from that of the coin C to be sorted has been accommodated in the first coin accommodating box 31. Accordingly, the CPU 60 reads out information stored in the RAM 62 and judges whether or not at least one coin C is accommodated in the second coin accommodating box 32.

When the CPU 60 judges that no coin C is accommodated in the second coin accommodating box 32, it further judges that the coin C should be accommodated in the second accommodating box 32. Then, the CPU 60 stores the result of this judgment in the RAM 62 and increments the count value of the counter for the second coin accommodating box 32 by one.

On the contrary, when the CPU judges that a coin C is accommodated in the second coin accommodating box 32, it further judges whether or not at least one coin is accommodated in the third coin accommodating box 33.

When the CPU 60 judges that no coin C is accommodated in the third coin accommodating box 33, it further judges that the coin C should be accommodated in the third accommodating box 33. Then, the CPU 60 stores the result of this judgment in the RAM 62 and increments the count value of the counter for the third coin accommodating box 33 by one.

On the contrary, when the CPU judges that a coin C is accommodated in the third coin accommodating box 33, it further judges whether or not at least one coin is accommodated in the fourth coin accommodating box 34.

When the CPU 60 judges that no coin C is accommodated in the fourth coin accommodating box 34, it further judges that the coin C should be accommodated in the fourth accommodating box 34. Then, the CPU 60 stores the result of this judgment in the RAM 62 and increments the count value of the counter for the fourth coin accommodating box 34 by one.

On the contrary, when the CPU 60 judges that a coin C is accommodated in the fourth coin accommodating box 34, it further judges whether or not a coin is accommodated in the fifth coin accommodating box 35.

When the CPU 60 judges that a coin C is accommodated in the fifth coin accommodating box 35, since it can be considered that all of the first, second, third, fourth and fifth coin accommodating boxes 31, 32, 33, 34, 35 accommodate a coin C the denomination of which is different from that of the coin C to be sorted, the CPU 60 judges that a drive signal should be output to the solenoid 86 for driving the stopper 9 when the coin sensor 8 detects the coin C and a detection signal is input therefrom and the coin C should be prevented by the stopper 9 from being fed into the coin sorting passage 10 and stores the result of this judgment in the RAM 62.

On the contrary, when the CPU 60 judges that no coin C is accommodated in the fifth coin accommodating box 35, since the coin C can be accommodated in the fifth coin accommodating box 35, it further judges that the coin C should be accommodated in the fifth accommodating box 35. Then, the CPU 60 stores the result of this judgment in the RAM 62 and increments the count value of the counter for the fourth coin accommodating box 35 by one.

The coin C is further transported in the coin passage 4 and detected by the coin sensor 8. When a detection signal is output from the coin sensor 8 to the CPU 60, the CPU 60 reads out information stored in the RAM 62 and when the CPU 60 judges that the drive signal should be output to the solenoid 86 for driving the stopper 9, it outputs the drive signal to the solenoid 86, whereby the stopper 9 prevents the coin C from being fed into the coin sorting passage 10. Simultaneously, the CPU 60 outputs drive stop signals to the motor 87 for rotating the rotary disk 1, the first drive means 88 for driving the transporting belt 5 and the second drive means 89 for driving the transporting belt 13 and stops the rotation of the rotary disk 1, the driving of the transporting belt 5 and the driving of the transporting belt 13 so that the sorting operation is stopped. When the sorting operation has stopped, the CPU 60 outputs a display signal to the display section 65 so as to cause it to display information showing that the sorting operation has been stopped.

On the other hand, when the CPU 60 does not judge that the drive signal should be output to the solenoid 86 for driving the stopper 9, it does not output any drive signal to the solenoid 86. As a result, the coin C is further fed into the coin sorting passage 10 and transported therein along the reference guide wall 14 by the transporting belt 13.

In the case where the CPU 60 judges that the coin C is unacceptable, when the unacceptable coin sensor 50 detects the coin C and a detection signal is input from the unacceptable coin sensor 50, the CPU 60 outputs the drive signal to a solenoid 80, thereby rotating the unacceptable coin collecting means 40 clockwise about 90 degree in FIG. 1 and projecting it into the coin sorting passage 10 from the reference guide wall 14.

As a result, the coin C is led to the unacceptable coin collection opening 20 and falls thereinto so as to be collected in the unacceptable coin collecting box 30 in a similar manner to that explained in connection with the first sensor 51, the first sorting means 41 and the first sorting opening 21 with reference to FIGS. 2, 3 and 4. Simultaneously with outputting the drive signal to the solenoid 80, the CPU 60 outputs the display signal to the display section 65 so as to increase the displayed number of unacceptable coins by one.

On the contrary, when the CPU 60 judges that the coin C is acceptable, even if the unacceptable coin sensor 50 detects the coin C and the detection signal is input from the unacceptable coin sensor 50, the CPU 60 does not output any drive signal to the solenoid 80.

As a result, since the unacceptable coin collecting means 40 is held so that its flat side surface is aligned with the inner surface of the reference guide wall 14 of the coin sorting passage 10 and the length of the unacceptable coin collecting opening 20 in the widthwise direction of the coin sorting passage 10 is formed smaller than the diameter of the smallest coin C to be handled, the coin C passes on the unacceptable coin collecting opening 20 in a similar manner to that explained in connection with the first sorting means 41 and the first sorting opening 21 with reference to FIG. 5 and is fed in the coin sorting passage 10 toward the first sensor 51.

When the first sensor 51 detects the coin C and a detection signal is input from the first sensor 51 into the CPU 60, the CPU 60 reads out information stored in the RAM 62 and judges whether or not it decided that the coin C should be accommodated in the first accommodating box 31.

When the CPU 60 decided that the coin C should be accommodated in the first accommodating box 31, it outputs a drive signal to the first solenoid 81, thereby rotating the first sorting means 41 clockwise about 90 degree in FIG. 1 and projecting it into the coin sorting passage 10 from the reference guide wall 14.

As a result, the coin C is led to the first sorting opening 21 and falls thereinto so as to be accommodated in the first coin accommodating box 31 as explained above with reference to FIGS. 2, 3 and 4. Simultaneously with outputting the drive signal to the first solenoid 81, the CPU 60 outputs a display signal to the display section 65, thereby to increase the displayed number of coins C of the denomination decided to be accommodated in the first coin accommodating box 31 by one.

On the contrary, when the CPU 60 did not decide that the coin C should be accommodated in the first coin accommodating box 31, even if the detection signal is input from the first sensor 51, the CPU 60 does not output any drive signal to the first solenoid 81. As a result, since the first sorting means 41 is held so that its flat side surface is aligned with the inner surface of the reference guide wall 14 of the coin sorting passage 10 and the length of the first sorting opening 21 in the widthwise direction of the coin sorting passage 10 is formed smaller than the diameter of the smallest coin C to be handled, the coin C passes on the first sorting opening 21 as shown in FIG. 5 and is fed in the coin sorting passage 10 toward the second sensor 52.

When the second sensor 52 detects the coin C and a detection signal is input from the second sensor 52 into the CPU 60, the CPU 60 reads out information stored in the RAM 62 and judges whether or not it decided that the coin C should be accommodated in the second accommodating box 32.

When the CPU 60 decided that the coin C should be accommodated in the second accommodating box 32, it outputs a drive signal to the second solenoid 82, thereby rotating the second sorting means 42 clockwise about 90 degree in FIG. 1 and projecting it into the coin sorting passage 10 from the reference guide wall 14.

As a result, the coin C is led to the second sorting opening 22 and falls thereinto so as to be accommodated in the second coin accommodating box 32 as explained above regarding the first sorting means 41 and the first sorting opening 21 with reference to FIGS. 2, 3 and 4. Simultaneously with outputting the drive signal to the second solenoid 82, the CPU 60 outputs a display signal to the display section 65, thereby to increase the displayed number of coins C of the denomination decided to be accommodated in the second coin accommodating box 32 by one.

On the contrary, when the CPU 60 did not decide that the coin C should be accommodated in the second coin accommodating box 32, even if the detection signal is input from the second sensor 52, the CPU 60 does not output any drive signal to the second solenoid 82. As a result, since the second sorting means 42 is held so that its flat side surface is aligned with the inner surface of the reference guide wall 14 of the coin sorting passage 10 and the length of the second sorting opening 22 in the widthwise direction of the coin sorting passage 10 is formed smaller than the diameter of the smallest coin C to be handled, the coin C passes on the second sorting opening 22 in a similar manner shown in FIG. 5 and is fed in the coin sorting passage 10 toward the third sensor 53.

When the third sensor 53 detects the coin C and a detection signal is input from the third sensor 53 into the CPU 60, the CPU 60 reads out information stored in the RAM 62 and judges whether or not it decided that the coin C should be accommodated in the third accommodating box 33.

When the CPU 60 decided that the coin C should be accommodated in the third accommodating box 33, it outputs a drive signal to the third solenoid 83, thereby rotating the third sorting means 43 clockwise about 90 degree in FIG. 1 and projecting it into the coin sorting passage 10 from the reference guide wall 14.

As a result, the coin C is led to the third sorting opening 23 and falls thereinto so as to be accommodated in the third coin accommodating box 33 as explained above regarding the first sorting means 41 and the first sorting opening 21 with reference to FIGS. 2, 3 and 4. Simultaneously with outputting the drive signal to the third solenoid 83, the CPU 60 outputs a display signal to the display section 65, thereby to increase the displayed number of coins C of the denomination decided to be accommodated in the third coin accommodating box 33 by one.

On the contrary, when the CPU 60 did not decide that the coin C should be accommodated in the third coin accommodating box 33, even if the detection signal is input from the third sensor 53, the CPU 60 does not output any drive signal to the third solenoid 83. As a result, since the third sorting means 43 is held so that its flat side surface is aligned with the inner surface of the reference guide wall 14 of the coin sorting passage 10 and the length of the third sorting opening 23 in the widthwise direction of the coin sorting passage 10 is formed smaller than the diameter of the smallest coin C to be handled, the coin C passes on the third sorting opening 23 in a similar manner shown in FIG. 5 and is fed in the coin sorting passage 10 toward the fourth sensor 54.

When the fourth sensor 54 detects the coin C and a detection signal is input from the fourth sensor 54 into the CPU 60, the CPU 60 reads out information stored in the RAM 62 and judges whether or not it decided that the coin C should be accommodated in the fourth accommodating box 34.

When the CPU 60 decided that the coin C should be accommodated in the fourth accommodating box 34, it outputs a drive signal to the fourth solenoid 84, thereby rotating the fourth sorting means 44 clockwise about 90 degree in FIG. 1 and projecting it into the coin sorting passage 10 from the reference guide wall 14.

As a result, the coin C is led to the fourth sorting opening 24 and falls thereinto so as to be accommodated in the fourth coin accommodating box 34 as explained above regarding the first sorting means 41 and the first sorting opening 21 with reference to FIGS. 2, 3 and 4. Simultaneously with outputting the drive signal to the fourth solenoid 84, the CPU 60 outputs a display signal to the display section 65, thereby to increase the displayed number of coins C of the denomination decided to be accommodated in the fourth coin accommodating box 34 by one.

On the contrary, when the CPU 60 did not decide that the coin C should be accommodated in the fourth coin accommodating box 34, even if the detection signal is input from the fourth sensor 54, the CPU 60 does not output any drive signal to the fourth solenoid 84. As a result, since the fourth sorting means 44 is held so that its flat side surface is aligned with the inner surface of the reference guide wall 14 of the coin sorting passage 10 and the length of the fourth sorting opening 24 in the widthwise direction of the coin sorting passage 10 is formed smaller than the diameter of the smallest coin C to be handled, the coin C passes on the fourth sorting opening 24 in a similar manner shown in FIG. 5 and is fed in the coin sorting passage 10 toward the fifth sensor 55.

When the fifth sensor 55 detects the coin C and a detection signal is input from the fifth sensor 55 into the CPU 60, the CPU 60 outputs a drive signal to the fifth solenoid 85, thereby rotating the fifth sorting means 45 clockwise about 90 degree in FIG. 1 and projecting it into the coin sorting passage 10 from the reference guide wall 14.

As a result, the coin C is led to the fifth sorting opening 25 and falls thereinto so as to be accommodated in the fifth coin accommodating box 35 as explained above regarding the first sorting means 41 and the first sorting opening 21 with reference to FIGS. 2, 3 and 4. Simultaneously with outputting the drive signal to the fifth solenoid 85, the CPU 60 outputs a display signal to the display section 65, thereby to increase the displayed number of coins of the denomination decided to be accommodated in the fifth coin accommodating box 35 by one.

The reason why, when the fifth sensor 55 detects the coin C, the CPU 60 neither reads out information stored in the RAM 62 nor judges whether or not it decided that the coin C should be accommodated in the fifth accommodating box 35 is as follows. Four denominations of coins are handled in this embodiment and since unacceptable coins C have been collected in the unacceptable coin collecting box 30 an acceptable coins C have been accommodated in the first coin accommodating box 31 to the fourth coin accommodating box 35 in accordance with their denominations, the fact that the coin C is detected by the fifth sensor 55 means that although coins C of the same denomination as that of the coin C detected by the fifth sensor 55 have been accommodated in one of the first coin accommodating box 31 to the fifth coin accommodating box 35, since the number N of the coins C accommodated in the coin accommodating box has reached the predetermined number $N_0$, the coin C cannot be accommodated in the coin accommodating box and since the fifth coin accommodating box 35 has not accommodated any coin C or has accommodated coins of the same denomination as that of the coin C detected by the fifth sensor, the coin C has been transported to the fifth sensor 55 for being accommodated in the fifth coin accommodating box 35. Therefore, if the coin C detected by the fifth sensor 55 cannot be accommodated in the fifth coin accommodating box 35, this means that a coin C of different denomination from that of the coin C detected by the fifth sensor 55 has been already accommodated in the fifth coin accommodating box 35. However, in such a case, since the CPU 60 outputs the drive signal to the solenoid 80 so as to rotate the stopper 9, thereby preventing the coin C from being fed into the coin sorting passage 10 and outputs drive stop signals to the motor 87 for rotating the rotary disk 1, the first drive means 88 for driving the transporting belt 5 and the second drive means 89 for driving the transporting belt 13 so as to stop the rotation of the rotary disk 1 and the driving of the transporting belt 5 and the transporting belt 13, thereby stopping the sorting operation, the coin C detected by the fifth sensor 55 is necessarily accommodated in the fifth coin accommodating box 35. Therefore, in the case where the fifth sensor 55 detects the coin C, the CPU 60 outputs the drive signal to the fifth solenoid 85 without reading out information stored in the RAM 62 and causes it to rotate the fifth sorting means 45 so that the coin C is accommodated in the fifth coin accommodating box 35. Accordingly, in this embodiment, in the case where the first sorting mode is selected, the coin collecting box 36 is not used.

According to this embodiment, in the case where four denominations of coins C are handled, the coin sorting apparatus is provided with the first coin accommodating box 31 to the fifth coin accommodating box 35 for accommodating acceptable coins C and is constituted so that when one of the coin accommodating boxes is full of coins C, the coins C of the denomination to be accommodated in that coin accommodating box are automatically accommodated in a coin accommodating box which has not accommodated any coin C. Therefore, since the coins C deposited into the coin receiving machine generally include a lot of coins C of a specific denomination, if a coin C of the denomination cannot be accommodated in the coin accommodating box which has been accommodating the coins C of the denomination, it is possible to accommodate the coins C of the denomination in another coin accommodating box, thereby preventing the sorting operation from being stopped and enabling efficient sorting of coins C.

Figures 8, 8A:
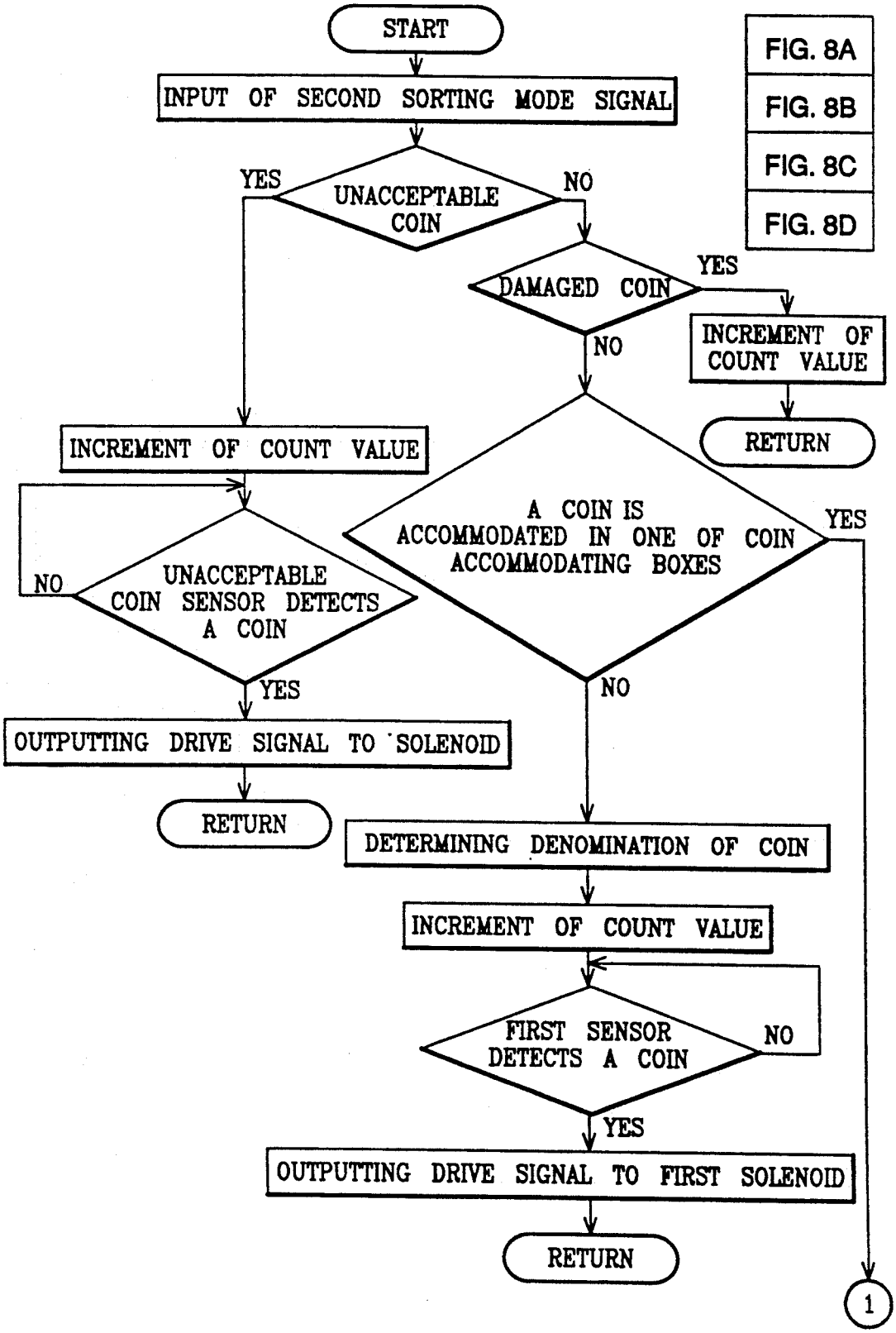
FIG. 8 is a chart showing the sequence of the flow charts of FIGS. 8A through 8D.
FIG. 8A is a flow chart showing a sorting operation effected by the coin sorting apparatus shown in FIGS. 1 to 6 when a second sorting mode is selected in a sorting mode selection means.
Figure 8B:
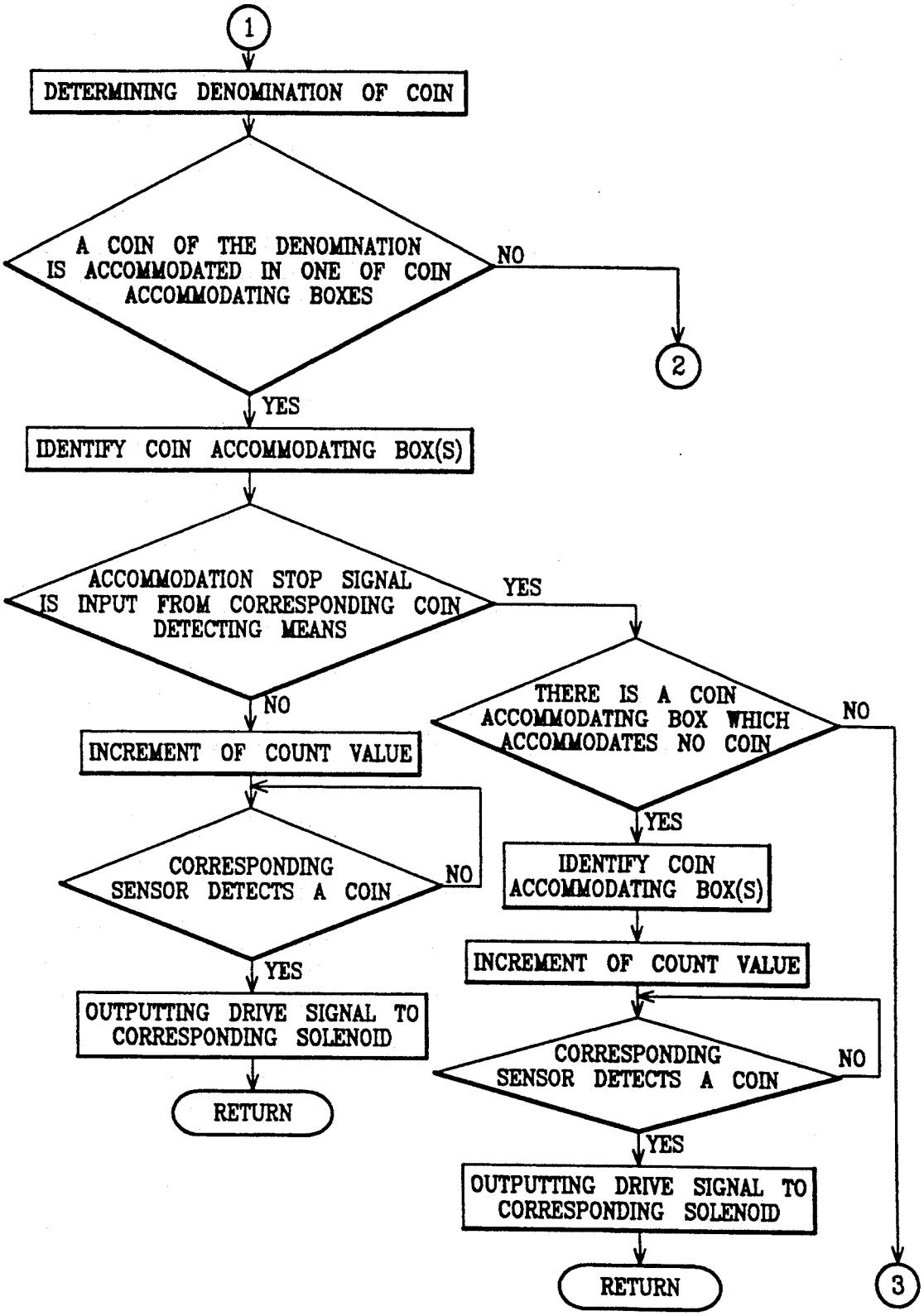
FIG. 8B is a continuation of the flow chart of FIG. 8A.
Figure 8C:
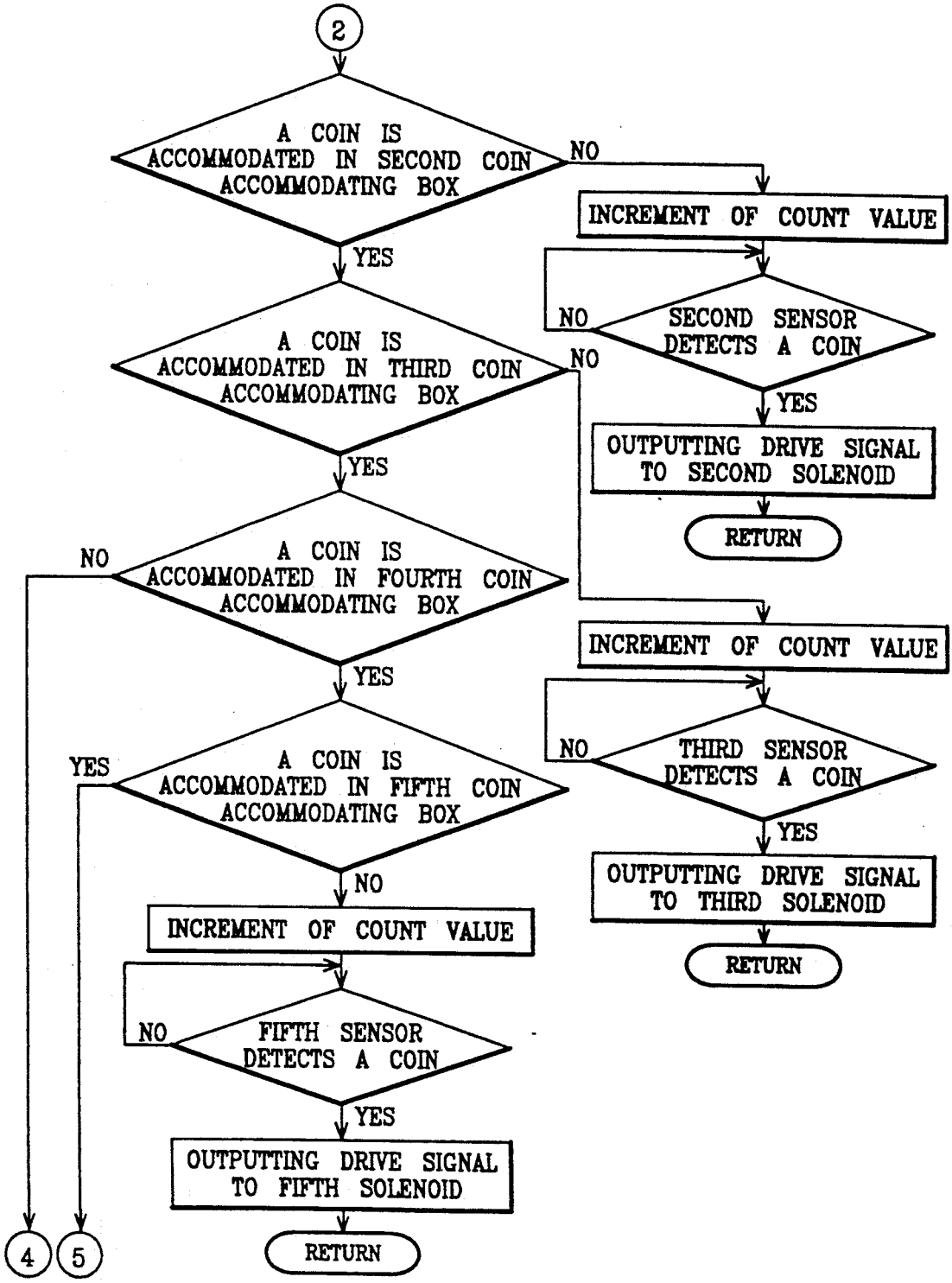
FIG. 8C is a continuation of the flow chart of FIG. 8B.
Figure 8D:
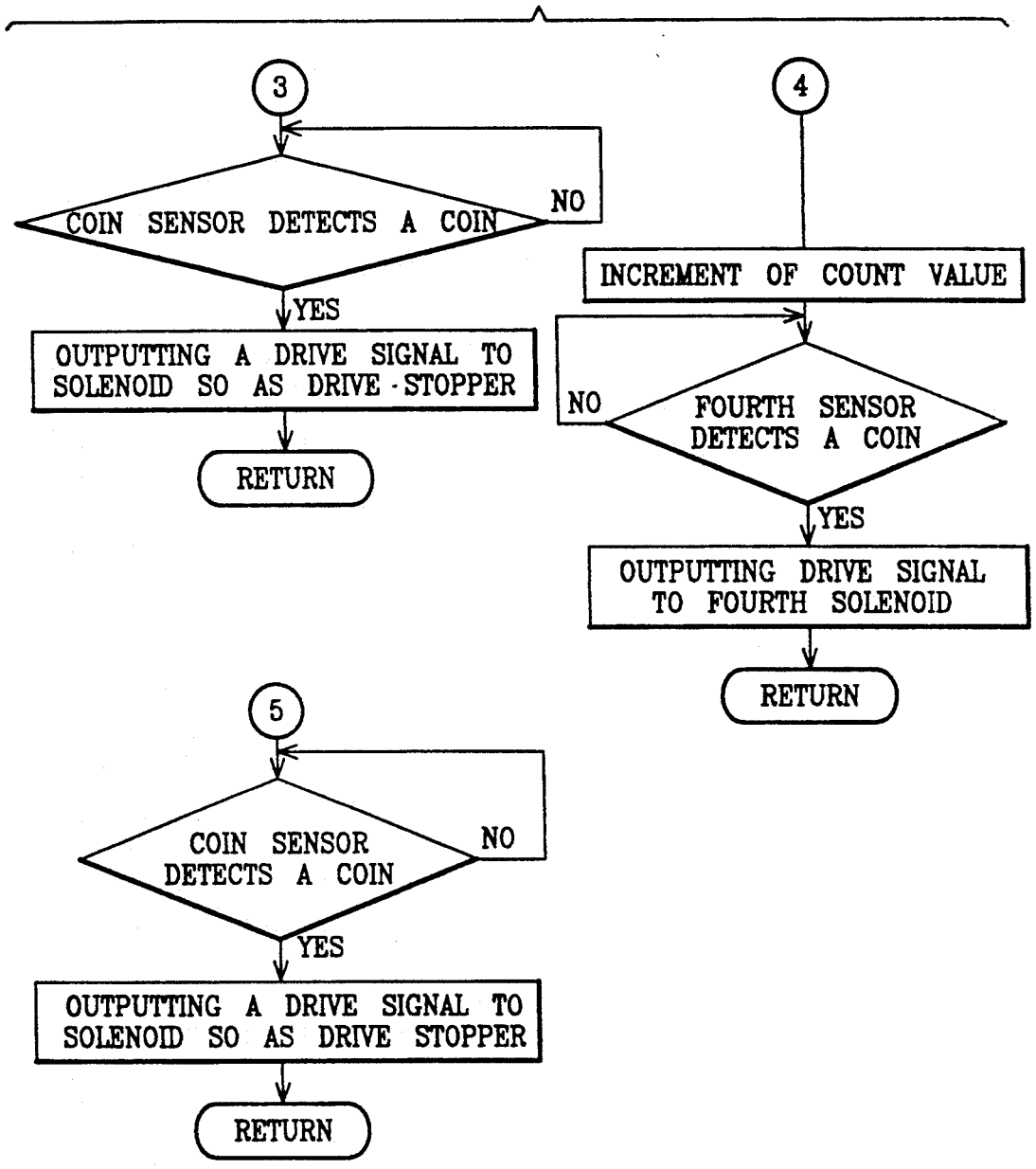
FIG. 8D is a continuation of the flow chart of FIG. 8C.

FIG. 8 is a flow chart relating to an embodiment of the coin sorting apparatus shown in FIG. 6 in which four denominations of coins C are sorted and shows a sorting operation in the case where a second sorting mode is selected in the sorting mode selection means 63.

Referring to FIG. 8, when the operator operates the start button 64 and starts the coin receiving operation of the coin receiving machine, a start signal is input from the start button 64 into the CPU 60 and when the operator selects a second sorting mode, a second sorting mode signal is output from the sorting mode selection means 63 to the CPU 60.

When the CPU 60 receives the start signal, it outputs a drive signal to the motor 87, thereby rotating the rotary disk 1 and outputs drive signals to the first drive means 88 and the second drive means 89, thereby driving the transporting belt 5 and the transporting belt 13.

As a result, the coins C deposited into the coin receiving machine and fed onto the rotary disk 1 are fed to the opening 3 along the guide wall 2 by the centrifugal force produced by the rotation of the rotary disk 1 and further fed into the coin passage 4.

Each coin C fed into the coin passage 4 is held between the transporting belt 5 and the upper surface of the coin passage 4 and transported downstream in the coin passage 4 by the transporting belt 5. Then, the material of the coin C is detected by the magnetic sensor 6 and the diameter thereof is detected by the optical sensor 7, and the detection signals are output into the CPU 60.

The CPU 60 compares the detection signals from the magnetic sensor 6 and the optical sensor 7 with the reference data stored in the ROM 61, judges whether or not the coin C is acceptable, judges whether or not the damage level of the coin C is lower than a predetermined level and determines the denomination thereof. Then, it stores the result of this judgment in the RAM 62.

Simultaneously, when the CPU 60 judges that the coin C is an unacceptable coin such as counterfeit coin, foreign coin or the like, it judges that the coin C should be accommodated in the unacceptable coin collecting box 30. Then, the CPU 60 stores the result of this judgment in the RAM 62 and increments the count value of the counter provided in the RAM 62 for the unacceptable coin collecting box 30 by one. Further, when the CPU 60 judges that the damage level of the coin C is not lower than the predetermined level, it further judges that the coin C is a damaged coin C and should be accommodated in the coin collecting box 36. Then, the CPU 60 stores the result of this judgment in the RAM 62 and increments the count value of the counter for the coin collecting box 36 by one.

On the contrary, when the CPU 60 judges that the coin C is an acceptable coin and that the damage level is lower than the predetermined level, it reads out information stored in the RAM 62 and judges whether or not a coin is accommodated in any one of the first coin accommodating box 31, the second coin accommodating box 32, the third coin accommodating box 33, the fourth coin accommodating box 34 and the fifth coin accommodating box 35. When the result is NO, the CPU 60 judges that the coin C should be accommodated in the first coin accommodating box 31. Then it stores the result of this judgment in the RAM 62 and increments the count value of the counter provided in the RAM 62 for the first coin accommodating box 31 by one.

On the other hand, when the result is YES, the CPU 60 reads out information stored in the RAM 62 and judges whether or not there is a coin accommodating box which has accommodated a coin the denomination of which is the same as that of the coin C to be sorted.

When the result is YES, the CPU 60 judges in which of the first coin accommodating box 31, the second coin accommodating box 32, the third coin accommodating box 33, the fourth coin accommodating box 34 and the fifth coin accommodating box 35 the coin the denomination of which is the same as that of the coin C to be sorted is accommodated and further judges whether or not an accommodation stop signal(s) has been input from the coin number detecting means associated with all of the coin accommodating box(es).

As a result, when no accommodation stop signal has been input from the coin number detecting means associated with all of the coin accommodating box(es) which has accommodated the coin the denomination of which is the same as that of the coin C to be sorted, since the number N of coins C accommodated in the coin accommodating box has not reached the predetermined number $N_0$ yet and it is possible for the coin accommodating box to accommodate the coin C, the CPU 60 judges that the coin C should be accommodated in the coin accommodating box. Then, the CPU 60 stores the result of this judgment in the RAM 62 and increments the count value of the counter for the coin accommodating box by one.

On the other hand, when the accommodation stop signal has been input from the coin number detecting means associated with all of the coin accommodating box(es) which has accommodated the coin the denomination of which is the same as that of the coin C to be sorted, since the coin accommodating box cannot accommodate the coin C, the CPU 60 further judges whether or not there is any coin accommodating box which has not accommodated any coin C. When the result is YES, the CPU 60 judges that the coin C should be accommodated in the coin accommodating box. Then, the CPU 60 stores the result of this judgment in the RAM 62 and increments the count value of the counter for the coin accommodating box by one.

On the contrary, when the CPU 60 judges that there is no coin accommodating box which has not accommodated a coin C, since it is impossible to accommodate the coin C in any coin accommodating box and the sorting operation has to be stopped, the CPU 60 judges that a drive signal should be output to a solenoid 86 for driving the stopper 9 when the coin sensor 8 detects the coin C and a detection signal is input therefrom and the coin C should be prevented by the stopper 9 from being fed into the coin sorting passage 10 and stores the result of this judgment in the RAM 62.

On the contrary, when the CPU 60 judges that although at least one of the coin accommodating boxes has accommodated a coin C, there is no coin accommodating box which has accommodated a coin C the denomination of which is the same as that of the coin C to be sorted, since an acceptable coin C is first accommodated in the first coin accommodating box 31, it can be considered that a coin C of different denomination from that of the coin C to be sorted has been accommodated in the first coin accommodating box 31. Accordingly, the CPU 60 reads out information stored in the RAM 62 and judges whether or not at least one coin is accommodated in the second coin accommodating box 32.

When the CPU 60 judges that no coin C is accommodated in the second coin accommodating box 32, it further judges that the coin C should be accommodated in the second accommodating box 32. Then, the CPU 60 stores the result of this judgment in the RAM 62 and increments the count value of the counter for the second coin accommodating box 32 by one.

On the contrary, when the CPU 60 judges that a coin C is accommodated in the second coin accommodating box 32, it further judges whether or not at least one coin C is accommodated in the third coin accommodating box 33.

When the CPU 60 judges that no coin C is accommodated in the third coin accommodating box 33, it further judges that the coin C should be accommodated in the third accommodating box 33. Then, the CPU 60 stores the result of this judgment in the RAM 62 and increments the count value of the counter for the third coin accommodating box 33 by one.

On the contrary, when the CPU judges that a coin C is accommodated in the third coin accommodating box 33, it further judges whether or not at least one coin C is accommodated in the fourth coin accommodating box 34.

When the CPU 60 judges that no coin C is accommodated in the fourth coin accommodating box 34, it further judges that the coin C should be accommodated in the fourth accommodating box 34. Then, the CPU 60 stores the result of this judgment in the RAM 62 and increments the count value of the counter for the fourth coin accommodating box 34 by one.

On the contrary, when the CPU 60 judges that a coin C is accommodated in the fourth coin accommodating box 34, it further judges whether or not a coin C is accommodated in the fifth coin accommodating box 35.

When the CPU 60 judges that a coin C is accommodated in the fifth coin accommodating box 35, since it can be considered that the first, second, third, fourth and fifth coin accommodating boxes 31, 32, 33, 34, 35 accommodate a coin C the denomination of which is different from that of the coin C to be sorted, the CPU 60 judges that a drive signal should be output to .the solenoid 86 for driving the stopper 9 when the coin sensor 8 detects the coin C and a detection signal is input therefrom and the coin C should be prevented by the stopper 9 from being fed into the coin sorting passage 10 and stores the result of this judgment in the RAM 62.

On the contrary, when the CPU 60 judges that no coin C is accommodated in the fifth coin accommodating box 35, since the coin C can be accommodated in the fifth coin accommodating box 35, it further judges that the coin C should be accommodated in the fifth accommodating box 35. Then, the CPU 60 stores the result of this judgment in the RAM 62 and increments the count value of the counter for the fourth coin accommodating box 35 by one.

The coin C is further transported in the coin passage 4 and detected by the coin sensor 8. When a detection signal is output from the coin sensor 8 to the CPU 60, the CPU 60 reads out information stored in the RAM 62 and when the CPU 60 judges that the drive signal should be output to the solenoid 86 for driving the stopper 9, it outputs the drive signal to the solenoid 86, whereby the stopper 9 prevents the coin C from being fed into the coin sorting passage 10. Simultaneously, the CPU 60 outputs drive stop signals to the motor 87 for rotating the rotary disk 1, the first drive means 88 for driving the transporting belt 5 and the second drive means 89 for driving the transporting belt 13 and stops the rotation of the rotary disk 1, the driving of the transporting belt 5 and the driving of the transporting belt 13 so that the sorting operation is stopped. When the sorting operation has stopped, the CPU 60 outputs a display signal to the display section 65 so as to cause it to display information showing that the sorting operation has been stopped.

On the other hand, when the CPU 60 does not judge that the drive signal should be output to the solenoid 86 for driving the stopper 9, it does not output any drive signal to the solenoid 86. As a result, the coin C is further fed into the coin sorting passage 10 and transported therein along the reference guide wall 14 by the transporting belt 13.

In the case where the CPU 60 judges that the coin C is unacceptable, when the unacceptable coin sensor 50 detects the coin C and a detection signal is input from the unacceptable coin sensor 50, the CPU 60 outputs the drive signal to a solenoid 80, thereby rotating the unacceptable coin collecting means 40 clockwise about 90 degree in FIG. 1 and projecting it into the coin sorting passage 10 from the reference guide wall 14.

As a result, similarly to the previous embodiment, the coin C is led to the unacceptable coin collection opening 20 and falls thereinto so as to be collected in the unacceptable coin collecting box 30. Simultaneously with outputting the drive signal to the solenoid 80, the CPU 60 outputs the display signal to the display section 65 so as to increase the displayed number of unacceptable coins by one.

On the contrary, when the CPU 60 judges that the coin C is acceptable, even if the unacceptable coin sensor 50 detects the coin C and the detection signal is input from the unacceptable coin sensor 50, the CPU 60 does not output any drive signal to the solenoid 80.

As a result, similarly to the previous embodiment, the coin C passes on the unacceptable coin collecting opening 20 and is fed in the coin sorting passage 10 toward the first sensor 51.

When the first sensor 51 detects the coin C and a detection signal is input from the first sensor 51 into the CPU 60, the CPU 60 reads out information stored in the RAM 62 and judges whether or not it decided that the coin C should be accommodated in the first accommodating box 31.

When the CPU 60 decided that the coin C should be accommodated in the first accommodating box 31, it outputs a drive signal to the first solenoid 81, thereby rotating the first sorting means 41 clockwise about 90 degree in FIG. 1 and projecting it into the coin sorting passage 10 from the reference guide wall 14.

As a result, similarly to the previous embodiment, the coin C is led t the first sorting opening 21 and falls thereinto so as to be accommodated in the first coin accommodating box 31. Simultaneously with outputting the drive signal to the first solenoid 81, the CPU 60 outputs a display signal to the display section 65, thereby to increase the displayed number of coins C of the denomination decided to be accommodated in the first coin accommodating box 31 by one.

On the contrary, when the CPU 60 did not decide that the coin C should be accommodated in the first coin accommodating box 31, even if the detection signal is input from the first sensor 51, the CPU 60 does not output any drive signal to the first solenoid 81. As a result, similarly to the previous embodiment, the coin C passes on the first sorting opening 21 and is fed in the coin sorting passage 10 toward the second sensor 52.

When the second sensor 52 detects the coin C and a detection signal is input from the second sensor 52 into the CPU 60, the CPU 60 reads out information stored in the RAM 62 and judges whether or not it decided that the coin C should be accommodated in the second accommodating box 32.

When the CPU 60 decided that the coin C should be accommodated in the second accommodating box 32, it outputs a drive signal to the second solenoid 82, thereby rotating the second sorting means 42 clockwise about 90 degree in FIG. 1 and projecting it into the coin sorting passage 10 from the reference guide wall 14.

As a result, similarly to the previous embodiment, the coin C is led to the second sorting opening 22 and falls thereinto so as to be accommodated in the second coin accommodating box 32. Simultaneously with outputting the drive signal to the second solenoid 82, the CPU 60 outputs a display signal to the display section 65, thereby to increase the displayed number of coins C of the denomination decided to be accommodated in the second coin accommodating box 32 by one.

On the contrary, when the CPU 60 did not decide that the coin C should be accommodated in the second coin accommodating box 32, even if the detection signal is input from the second sensor 52, the CPU 60 does not output any drive signal to the second solenoid 82. As a result, similarly to the previous embodiment, the coin C passes on the second sorting opening 22 and is fed in the coin sorting passage 10 toward the third sensor 53.

When the third sensor 53 detects the coin C and a detection signal is input from the third sensor 53 into the CPU 60, the CPU 60 reads out information stored in the RAM 62 and judges whether or not it decided that the coin C should be accommodated in the third accommodating box 33.

When the CPU 60 decided that the coin C should be accommodated in the third accommodating box 33, it outputs a drive signal to the third solenoid 83, thereby rotating the third sorting means 43 clockwise about 90 degree in FIG. 1 and projecting it into the coin sorting passage 10 from the reference guide wall 14.

As a result, similarly to the previous embodiment, the coin C is led to the third sorting opening 23 and falls thereinto so as to be accommodated in the third coin accommodating box 33. Simultaneously with outputting the drive signal to the third solenoid 83, the CPU 60 outputs a display signal to the display section 65, thereby to increase the displayed number of coins C of the denomination decided to be accommodated in the third coin accommodating box 33 by one.

On the contrary, when the CPU 60 did not decide that the coin C should be accommodated in the third coin accommodating box 33, even if the detection signal is input from the third sensor 53, the CPU 60 does not output any drive signal to the third solenoid 83. As a result, similarly to the previous embodiment, the coin C passes on the third sorting opening 23 and is fed in the coin sorting passage 10 toward the fourth sensor 54.

When the fourth sensor 54 detects the coin C and a detection signal is input from the fourth sensor 54 into the CPU 60, the CPU 60 reads out information stored in the RAM 62 and judges whether or not it decided that the coin C should be accommodated in the fourth accommodating box 34.

When the CPU 60 decided that the coin C should be accommodated in the fourth accommodating box 34, it outputs a drive signal to the fourth solenoid 84, thereby rotating the fourth sorting means 44 clockwise about 90 degree in FIG. 1 and projecting it into the coin sorting passage 10 from the reference guide wall 14.

As a result, similarly to the previous embodiment, the coin C is led to the fourth sorting opening 24 and falls thereinto so as to be accommodated in the fourth coin accommodating box 34. Simultaneously with outputting the drive signal to the fourth solenoid 84, the CPU 60 outputs a display signal to the display section 65, thereby to increase the displayed number of coins C of the denomination decided to be accommodated in the fourth coin accommodating box 34 by one.

On the contrary, when the CPU 60 did not decide that the coin C should be accommodated in the fourth coin accommodating box 34, even if the detection signal is input from the fourth sensor 54, the CPU 60 does not output any drive signal to the fourth solenoid 84. As a result, similarly to the previous embodiment, the coin C passes on the fourth sorting opening 24 and is fed in the coin sorting passage 10 toward the fifth sensor 55.

When the fifth sensor 55 detects the coin C and a detection signal is input from the fifth sensor 55 into the CPU 60, the CPU 60 reads out information stored in the RAM 62 and judges whether or not it decided that the coin C should be accommodated in the fifth accommodating box 35.

When the CPU 60 decided that the coin C should be accommodated in the fifth accommodating box 35, it outputs a drive signal to the fifth solenoid 85, thereby rotating the fifth sorting means 45 clockwise about 90 degree in FIG. 1 and projecting it into the coin sorting passage 10 from the reference guide wall 14.

As a result, the coin C is led to the fifth sorting opening 25 and falls thereinto so as to be accommodated in the fifth coin accommodating box 35. Simultaneously with outputting the drive signal to the fifth solenoid 85, the CPU 60 outputs a display signal to the display section 65, thereby to increase the displayed number of coins C of the denomination decided to be accommodated in the fifth coin accommodating box 35 by one.

On the contrary, when the CPU 60 did not decide that the coin C should be accommodated in the fifth coin accommodating box 35, even if the detection signal is input from the fifth sensor 55, the CPU 60 does not output any drive signal to the fifth solenoid 85. As a result, since the fifth sorting means 45 is held so that its flat side surface is aligned with the inner surface of the reference guide wall 14 of the coin sorting passage 10 and the length of the fifth sorting opening 25 in the widthwise direction of the coin sorting passage 10 is formed smaller than the smallest coin C to be handled, the coin C passes on the fourth sorting opening 24 in a similar manner to that shown in FIG. 5 and is fed in the coin sorting passage 10 toward the sixth sensor 56.

The coin C fed toward the sixth sensor 56 is detected by the sixth sensor 56 and then falls in the coin collecting opening 26 so as to be collected in the coin collecting box 36. When a detection signal is input from the sixth sensor 56, the CPU 60 outputs a display signal to the display section so as to increase the displayed number of damaged coins C by one.

The reason why no sorting means is provided for the sixth sensor 56 and all coins C detected by the sixth sensor 56 are dropped in the coin collecting opening 26 so as to be collected in the coin collecting box 36 is as follows. In this embodiment, since four denominations of coins C are handled and the coin sorting apparatus is constituted so that unacceptable coins C are collected in the unacceptable coin collecting box 30 and that acceptable coins C are accommodated in the first coin accommodating box 31 to the fifth coin accommodating box 35 in accordance with their denominations, the fact that the coin C is detected by the sixth sensor 56 means that the coin C is a damaged coin C and should be collected in the coin collecting opening 26.

According to this embodiment, in the case where four denominations of coins C are handled, the coin sorting apparatus is provided with the first coin accommodating box 31 to the fifth coin accommodating box 35 for accommodating genuine coins C and is constituted so that when one of the coin accommodating boxes is full of coins C, the coins C of the denomination to be accommodated in that coin accommodating box are automatically accommodated in a coin accommodating box which has not accommodated any coin C. Therefore, since the coins C deposited into the coin receiving machine generally include a lot of coins C of a specific denomination, if a coin C of the denomination cannot be accommodated in the coin accommodating box which has been accommodating the coin C of the denomination, it is possible to accommodate the coins C of the denomination in another coin accommodating box, thereby preventing the sorting operation from being stopped and enabling efficient sorting of coins C. Further, it is possible to automatically sort out damaged coins C from undamaged coins C.

Figure 9:
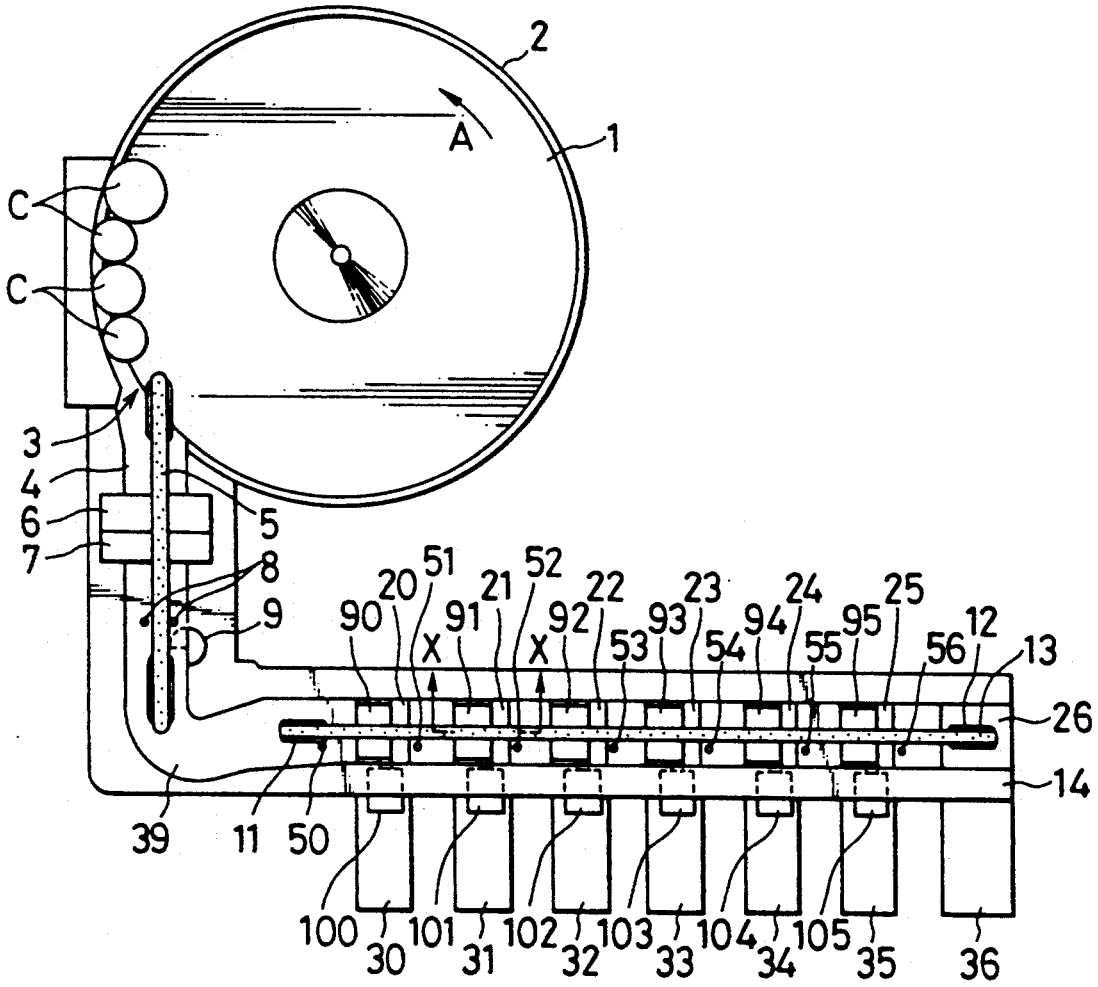
FIG. 9 is a schematic drawing showing a plan view of a coin receiving machine including a coin sorting apparatus which is another embodiment of the present invention.

FIG. 9 is a schematic drawing showing a plan view of a coin receiving machine including a coin sorting apparatus which is another embodiment of the present invention.

The coin sorting apparatus shown in FIG. 9 is different from the coin sorting apparatus shown in FIG. 6 in the configuration of the coin sorting passage 10.

More specifically, each of the unacceptable coin collecting opening 20, the first sorting opening 21, the second sorting opening 22, the third sorting opening 23, the fourth sorting opening 24 and the fifth sorting opening 25 is formed so that its opening has a sufficiently large size for dropping the largest coin C to be handled therein and, similarly to the previous embodiment, they respectively communicate with the unacceptable coin collecting box 30, the first coin accommodating box 31, the second coin accommodating box 32, the third coin accommodating box 33, the fourth coin accommodating box 34 and the fifth coin accommodating box 35. Below the unacceptable coin collecting opening 20, the first sorting opening 21, the second sorting opening 22, the third sorting opening 23, the fourth sorting opening 24 and the fifth sorting opening 25, there are respectively provided an unacceptable coin collecting drum 90, a first coin sorting drum 91, a second coin sorting drum 92, a third coin sorting drum 93, a fourth coin sorting drum 94 and a fifth coin sorting drum 95. Each of the unacceptable coin collecting drum 90, the first coin sorting drum 91, the second coin sorting drum 92, the third coin sorting drum 93, the fourth coin sorting drum 94 and the fifth coin sorting drum 95 has a shape obtained by cutting away a part of the side portion of a cylinder along a plane parallel to the axis thereof and they are arranged so that they can be rotated about shafts parallel to a line perpendicular to the longitudinal direction of the coin sorting passage 10 by a collection drum drive solenoid 100, a first drum drive solenoid 101, a second drum drive solenoid 102, a third drum drive solenoid 103, a fourth drum drive solenoid 104 and a fifth drum drive solenoid 105, respectively. Similarly to the previous embodiment, the unacceptable coin sensor 50, the first sensor 51, the second sensor 52, the third sensor 53, the fourth sensor 54 and the fifth sensor 55 are respectively arranged in the coin sorting passage 10 immediately upstream of the unacceptable coin collecting opening 20, the first sorting opening 21, the second sorting opening 22, the third sorting opening 23, the fourth sorting opening 24 and the fifth sorting opening 25. The configurations of the sixth sensor 56 and the coin collecting box are the same as those of the previous embodiment.

Figure 10:
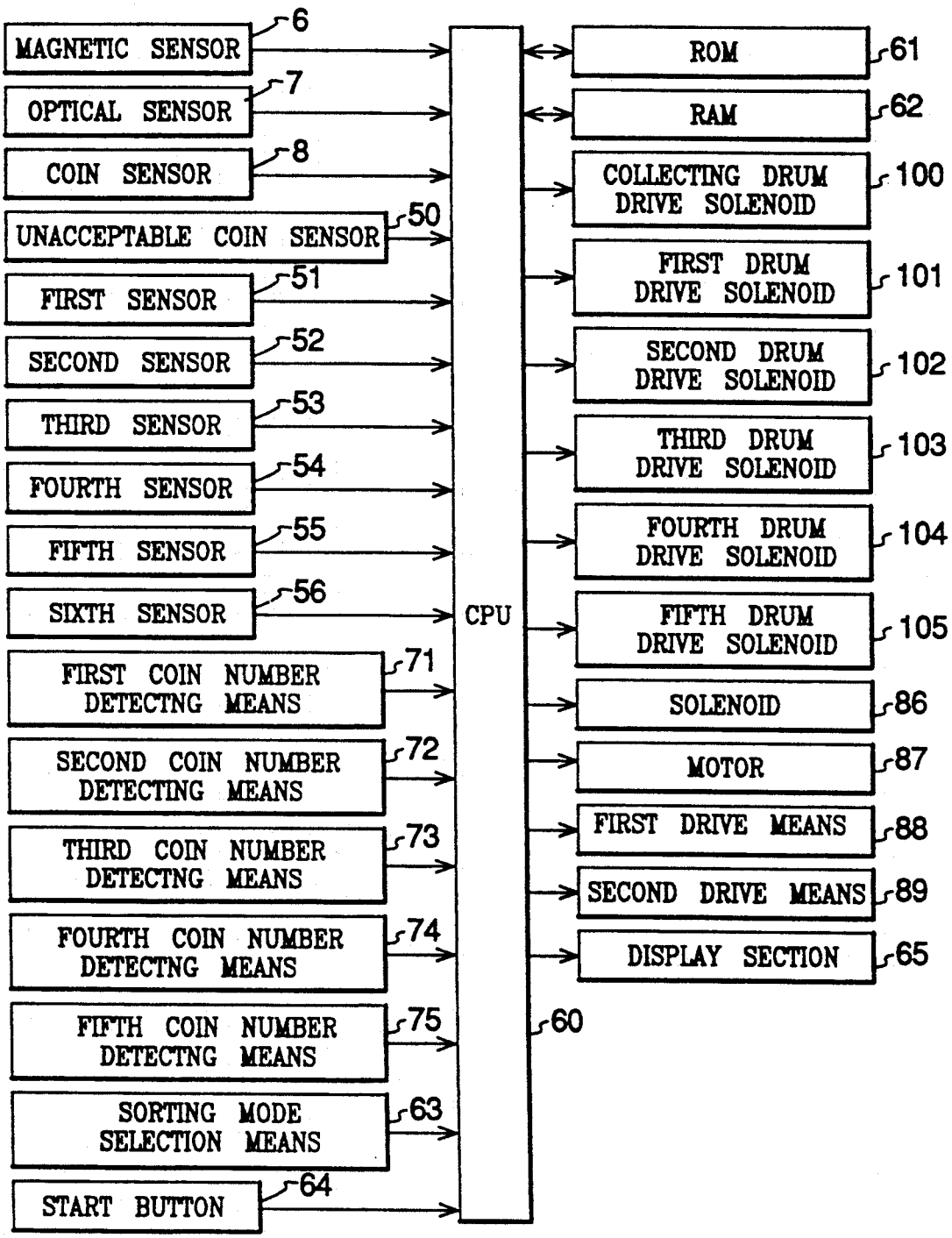
FIG. 10 is a block diagram showing a coin sorting apparatus shown in FIG. 9.

FIG. 10 is a block diagram of the coin sorting apparatus shown in FIG. 9.

The coin sorting apparatus shown in FIG. 10 is different from the coin sorting apparatus shown in FIG. 6 in that the collection drum drive solenoid 100, the first drum drive solenoid 101, the second drum drive solenoid 102, the third drum drive solenoid 103, the fourth drum drive solenoid 104 and the fifth drum drive solenoid 105 are provided instead of the solenoid 80, the first solenoid 81, the second solenoid 82, the third solenoid 83, the fourth solenoid 84 and the fifth solenoid 85. Other parts of the configuration are the same.

Figure 11:
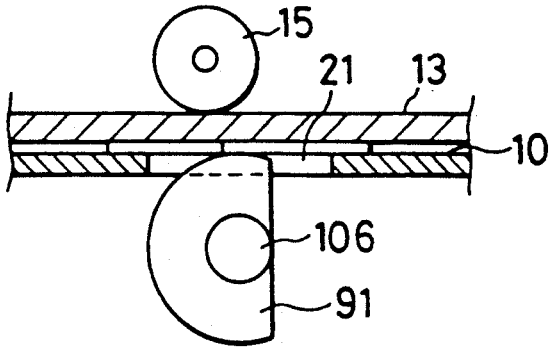
FIG. 11 is a schematic cross-sectional view taken along line X—X in FIG. 9 and showing a coin passing on a first sorting opening.
Figure 12:
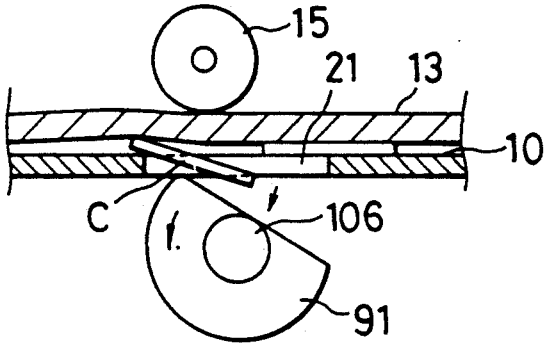
FIG. 12 is a schematic cross-sectional view taken along line X—X in FIG. 9 and showing a coin beginning to fall into a first sorting opening.
Figure 13:
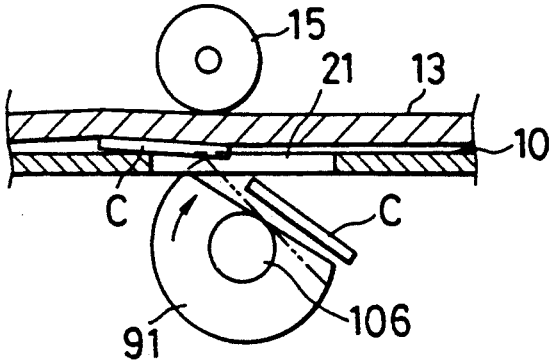
FIG. 13 is a schematic cross-sectional view taken along line X—X in FIG. 9 and showing a coin falling into a first sorting opening.

FIGS. 11, 12 and 13 are schematic drawings showing a cross-sectional view taken along line X—X in FIG. 9. FIG. 11 shows a coin C passing on the first sorting opening 21. FIG. 12 shows the coin C beginning to fall into the first sorting opening 21. FIG. 13 shows the coin C falling into the first sorting opening 21.

As shown in FIG. 11, the first sorting drum 91 is held so that its cylindrical side surface is positioned at substantially the same level as that of the surface of the coin sorting passage 10, when the coin C is caused to pass on the first sorting opening 21 and to be fed downstream in the coin sorting passage 10. A press roller 15 is provided on the upper surface of the transporting belt 13 above the first sorting drum 91. The size of the first sorting opening 21, the shape of the first sorting drum 91, the positional relationship between the first sorting drum 91 and the first sorting opening 21 and the pressing force of the transporting belt 13 and the press roller 15 are determined so that under this state, the smallest coin C to be handled cannot fall through an opening of the first sorting opening 21 on the left side of the first sorting drum 91 and an opening of the first sorting opening 21 on the right side of the first sorting drum 91 in FIG. 11. More specifically, the size of the first sorting opening 21, the shape of the first sorting drum 91, the positional relationship between the first sorting drum 91 and the first sorting opening 21 and the pressing force of the transporting belt 13 and the press roller 15 are determined so that even when the coin C reaches on the first sorting opening 21, the coin C does not fall into the first sorting opening 21 until the coin C is supported by the cylindrical side surface of the first sorting drum 91, that even when the coin C is not supported by the upper surface of the coin sorting passage 10 upstream of the first sorting opening 21, the coin C is supported by the cylindrical side surface of the first sorting drum 91 an does not fall into the first sorting opening 21 and that even when the coin C is not supported by the cylindrical side surface of the first sorting drum 91, the coin C does not fall into the first sorting opening 21 until it is supported by the upper surface of the coin sorting passage 10 downstream of the first sorting opening 21.

When the first sensor 51 detects a coin C and outputs a detection signal to the CPU 60, the CPU 60 reads out information stored in the RAM 62. As a result, when the CPU judges that it decided that the coin C should be accommodated in the first coin accommodating box 31, it outputs a drive signal to the first drum drive solenoid 101. Then, as shown in FIG. 12, the first sorting drum 91 is rotated counterclockwise about a shaft 106 by the first drum drive solenoid 101. As a result, since the cylindrical side surface of the first sorting drum 91 is lowered below the surface of the coin sorting passage 10, the coin C cannot be supported by the cylindrical side surface of the first sorting drum 91 and begins to fall into the first sorting opening 21. Then, as shown in FIG. 13, the coin C falls in the first sorting opening 21 along the flat side surface of the first sorting drum 91 and is collected in the first coin accommodating box 31 communicating with the first sorting opening 21.

When a predetermined time period has passed during which detection signal was input from the first sensor 51, the CPU 60 outputs a return signal to the first drum drive solenoid 101. As a result, the first sorting drum 91 is rotated clockwise about the shaft 106 in FIG. 13 by the first drum drive solenoid 101 and returned to the position shown in FIG. 11. The predetermined time period is determined so that once the coin C begins to fall along the flat side surface of the first sorting drum 91, it will be accommodated in the first coin accommodating box 31 without fail even if the CPU 60 outputs the return signal to the first drum drive solenoid 101 to return the first sorting drum 91 to the position shown in FIG. 11.

Although FIGS. 11, 12 and 13 show only the first sorting opening 21 and the first sorting drum 91, each of the unacceptable coin collecting opening 20, the second sorting opening 22, the third sorting opening 23, the fourth sorting opening 24 and the fifth sorting opening 25 has the same configuration as that of the first sorting opening 21 and each of the unacceptable coin collecting drum 90, the second sorting drum 92, the third sorting drum 93, the fourth sorting drum 94 and the fifth sorting drum 95 has the same configuration and operates in the same manner as that of the first sorting drum 91.

In the case where the first sorting mode is selected in the sorting mode selection means 63, the coin sorting apparatus according to this embodiment can sort coins C in a similar manner to that shown in FIG. 7 except that the CPU 60 outputs drive signals to the collection drum drive solenoid 100, the first drum drive solenoid 101, the second drum drive solenoid 102, the third drum drive solenoid 103, the fourth drum drive solenoid 104 and the fifth drum drive solenoid 105 instead of to the solenoid 80, the first solenoid 81, the second solenoid 82, the third solenoid 83, the fourth solenoid 84 and the fifth solenoid 85, thereby to rotate the unacceptable coin collecting drum 90, the first sorting drum 91, the second sorting drum 92, the third sorting drum 93, the fourth sorting drum 94 and the fifth sorting drum 95 instead of the unacceptable coin collecting means 40, the first sorting means 41, the second sorting means 42, the third sorting means 43, the fourth sorting means 44 and the fifth sorting means 45.

Further, in the case where the second sorting mode is selected in the sorting mode selection means 63, the coin sorting apparatus according to this embodiment can sort coins C in a similar manner to that shown in FIG. 8 except that the CPU 60 outputs drive signals t the collection drum drive solenoid 100, the first drum drive solenoid 101, the second drum drive solenoid 102, the third drum drive solenoid 103, the fourth drum drive solenoid 104 and the fifth drum drive solenoid 105 instead of to the solenoid 80, the first solenoid 81, the second solenoid 82, the third solenoid 83, the fourth solenoid 84 and the fifth solenoid 85, thereby to rotate the unacceptable coin collecting drum 100, the first sorting drum 101,.the second sorting drum 102, the third sorting drum 103, the fourth sorting drum 104 and the fifth sorting drum 105 instead of the unacceptable coin collecting means 40, the first sorting means 41, the second sorting means 42, the third sorting means 43, the fourth sorting means 44 and the fifth sorting means 45.

This embodiment provides the same effects as those of the previous embodiment.

Figure 14:
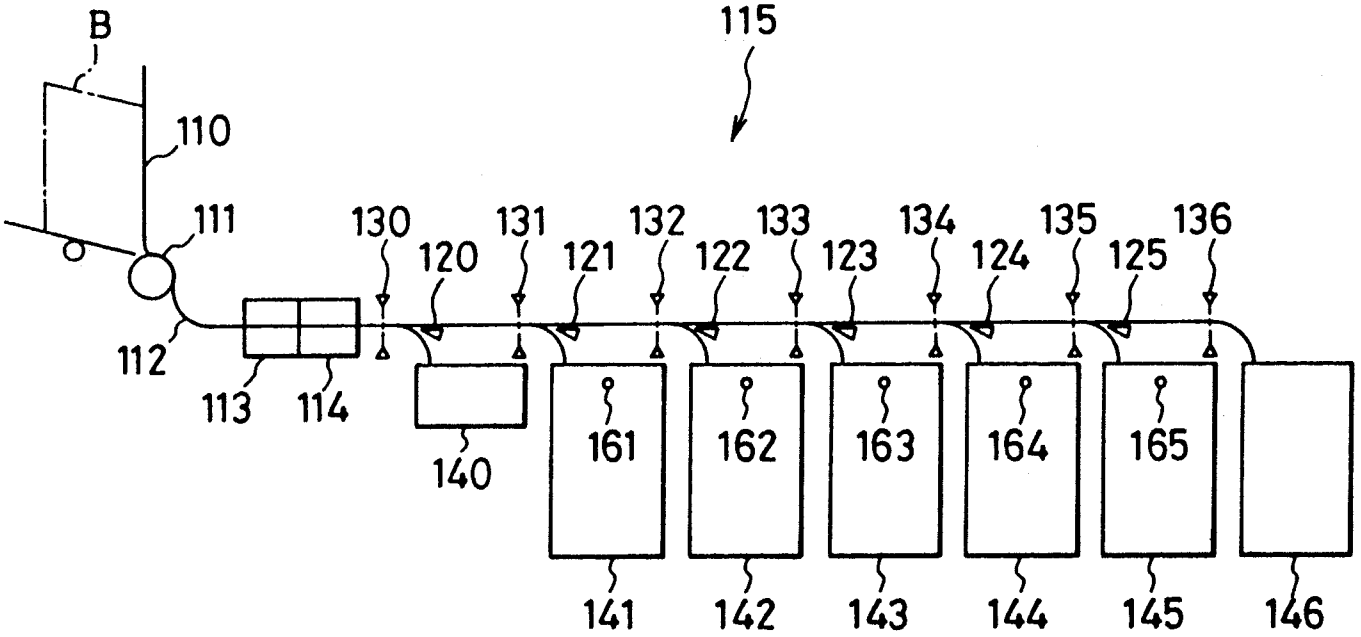
FIG. 14 is a schematic, drawing showing a side view of a bill sorting apparatus which is a further embodiment of the present invention.

FIG. 14 is a schematic drawing showing a side view of a bill receiving machine including a bill sorting apparatus which is a further embodiment of the present invention.

Referring to FIG. 14, a bill receiving machine including a bill sorting apparatus which is a further embodiment of the present invention comprises a bill stacking section 110 for stacking bills B deposited therein and take-out rollers 111 adapted for abutting against the lower surface of the lowermost bill B among the bills B stacked in the bill stacking section 110 and taking out the bills B from the bill stacking section 110 into a bill passage 112 one by one by a frictional force produced between themselves and the lower surface of the lowermost bill B by the rotation thereof.

In the bill passage 112, there are provided a magnetic sensor 113 for magnetically detecting the materials of bills B and an optical sensor 114 for optically detecting shapes and printed patterns of bills B and detection signals are output therefrom to a CPU described later.

A bill sorting passage 115 is connected to the downstream end of the bill passage 112 and in the bill sorting passage 115 there are provided a unacceptable bill collecting fork 120, a first fork 121, a second fork 122, a third fork 123, a fourth fork 124 and a fifth fork 125. A unacceptable bill sensor 130, a first bill sensor 131, a second bill sensor 132, a third bill sensor 133, a fourth bill sensor 134 and a fifth bill sensor 135 are respectively arranged in the bill sorting passage 115 immediately upstream of the unacceptable bill collecting fork 120, the first fork 121, the second fork 122, the third fork 123, the fourth fork 124 and the fifth fork 125.

Below the unacceptable bill collecting fork 120, the first fork 121, the second fork 122, the third fork 123, the fourth fork 124 and the fifth fork 125, there are respectively provided an unacceptable bill collecting box 140, a first bill accommodating box 141, a second bill accommodating box 142, a third bill accommodating box 143, a fourth bill accommodating box 144 and a fifth bill accommodating box 145. When drive signals are output from the CPU 60 described later to a collecting fork drive solenoid (not shown), a first fork drive solenoid (not shown), a second fork drive solenoid (not shown), a third fork drive solenoid (not shown), a fourth fork drive solenoid (not shown) or a fifth fork drive solenoid (not shown), the unacceptable bill collecting fork 120, the first fork 121, the second fork 122, the third fork 123, the fourth fork 124 or the fifth fork 125 is driven, whereby the bill B being transported in the bill sorting passage 115 is accommodated in the unacceptable bill collecting box 140, the first bill accommodating box 141, the second bill accommodating box 142, the third bill accommodating box 143, the fourth bill accommodating box 144 or the fifth bill accommodating box 145.

Further, a sixth bill sensor 136 is provided down stream of the fifth fork 125 in the bill sorting passage 115 and a bill collecting box 146 is provided downstream of the sixth bill sensor 136 and below the bill sorting passage 115.

Figure 15:
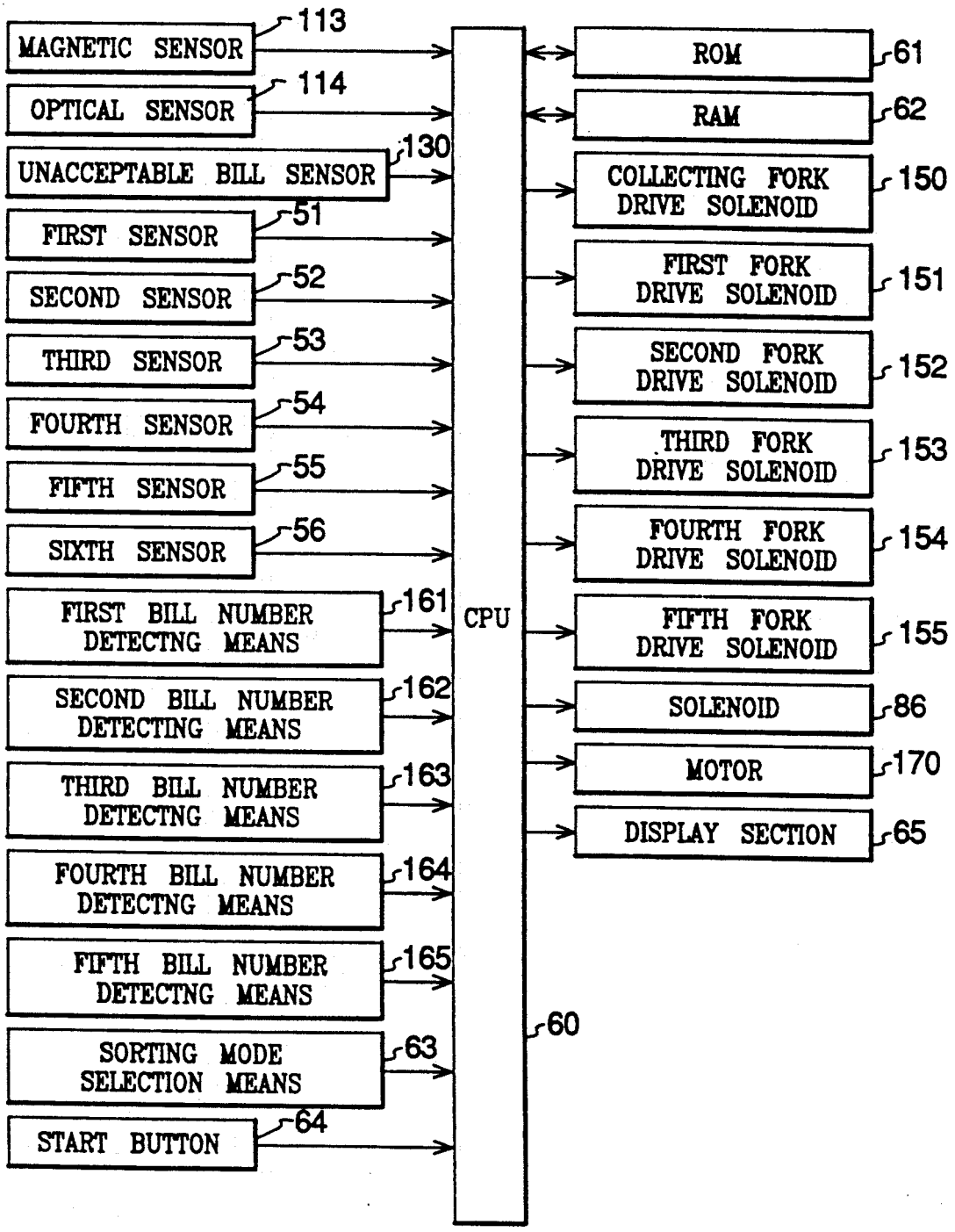
FIG. 15 is a block diagram of the bill sorting apparatus shown in FIG. 14.

FIG. 15 is a block diagram of the bill sorting apparatus shown in FIG. 14.

The bill sorting apparatus shown in FIGS. 14 and 15 is adapted for sorting bills B and comprises the collecting fork drive solenoid 150, the first fork drive solenoid 151, the second fork drive solenoid 152, the third fork drive solenoid 153, the fourth fork drive solenoid 154 and the fifth fork drive solenoid 155 respectively corresponding to the solenoid 80, the first solenoid 81, the second solenoid 82, the third solenoid 83, the fourth solenoid 84 and the fifth solenoid 85 of the coin sorting apparatus shown in FIG. 6, and the unacceptable bill collecting fork 120, the first fork 121, the second fork 122, the third fork 123, the fourth fork 124 and the fifth fork 125 respectively corresponding to the unacceptable coin collecting means 40, the first sorting means 41, the second sorting means 42, the third sorting means 43, the fourth sorting means 44 and the fifth sorting means 45 of the coin sorting apparatus shown in FIG. 6. The bill sorting apparatus further comprises the unacceptable bill collecting box 140, the first bill accommodating box 141, the second bill accommodating box 142, the third bill accommodating box 143, the fourth bill accommodating box 144, the fifth bill accommodating box 145 and the bill collecting box 146 respectively corresponding to the unacceptable coin collecting box 30, the first coin accommodating box 31, the second coin accommodating box 32, the third coin accommodating box 33, the fourth coin accommodating box 34, the fifth coin accommodating box 35 and the coin collecting box 36 of the coin sorting apparatus shown in FIG. 6, and a first bill number detecting means 161, a second bill number detecting means 162, a third bill number detecting means 163, a fourth bill number detecting means 164 and a fifth bill number detecting means 165 which are respectively adapted for outputting accommodation stop signals to the CPU 60 when the number N of bills B accommodated in the first bill accommodating box 141, the second bill accommodating box 142, the third bill accommodating box 143, the fourth bill accommodating box 144 and the fifth bill accommodating box 145 has reached a predetermined number $N_0$ and respectively correspond to the first coin number detecting means 71, the second coin number detecting means 72, the third coin number detecting means 73, the fourth coin number detecting means 74 and the fifth coin number detecting means 75 of the coin sorting apparatus shown in FIG. 6. The take-out roller 111 can be rotated by a motor 170 which is adapted to drive a plurality of transporting belts (not shown) for transporting bills B in the bill passage 112 and the bill sorting passage 115.

In the thus constituted bill sorting apparatus, bills B can be sorted in a similar manner to that in which coins C can be sorted in the coin sorting apparatus shown in FIG. 6.

In the case where the first sorting mode is selected in the sorting mode selection means 63, in a similar manner to that in which coins C are sorted in the coin sorting apparatus shown in FIG. 6 in accordance with the flow chart shown in FIG. 7, the CPU 60 selectively outputs a drive signal to the collecting fork drive solenoid 150, the first fork drive solenoid 151, the second fork drive solenoid 152, the third fork drive solenoid 153, the fourth fork drive solenoid 154 or the fifth fork drive solenoid 155 and the unacceptable bill collecting fork 120, the first fork 121, the second fork 122, the third fork 123, the fourth fork 124 or the fifth fork 125 is selectively driven, whereby the bills B are sorted and accommodated in the unacceptable bill collecting box 140, the first bill accommodating box 141, the second bill accommodating box 142, the third bill accommodating box 143, the fourth bill accommodating box 144 and the fifth bill accommodating box 145.

More specifically, in the case where three denomination of bills B are sorted, unacceptable bills B such as counterfeit bills B, foreign bills B and the like are accommodated in the unacceptable bill collecting box 140 and acceptable bills B are accommodated in the first bill accommodating box 141, the second bill accommodating box 142 and the third bill accommodating box 143 in accordance with their denominations. When the number N of bills B accommodated in either of the first bill accommodating box 141, the second bill accommodating box 142 and the third bill accommodating box 143 reaches the predetermined number $N_0$, the bills B of the denomination to be accommodated in the bill accommodating box containing the predetermined number $N_0$ of bills B are first accommodated in the fourth bill accommodating box 144. Further, when the number N of bills B accommodated in any of the first bill accommodating box 141, the second bill accommodating box 142, the third bill accommodating box 143 and the fourth bill accommodating box 144 reaches the predetermined number $N_0$, the bills B of the denomination to be accommodated in the bill accommodating box containing the predetermined number $N_0$ of bills B are accommodated in the fifth bill accommodating box 145. Then, when the fourth bill accommodating box 144 and the fifth bill accommodating box 145 cannot accommodate the bill B which cannot be accommodated in any of the first bill accommodating box 141, the second bill accommodating box 142 and the third bill accommodating box 143, the bill sorting operation is stopped.

Further, in the case where the second sorting mode is selected in the sorting mode selection means 63, in a similar manner to that in which coins C are sorted in the coin sorting apparatus shown in FIG. 6 in accordance with the flow chart shown in FIG. 8, the CPU 60 selectively outputs a drive signal to the collecting fork drive solenoid 150, the first fork drive solenoid 151, the second fork drive solenoid 152, the third fork drive solenoid 153, the fourth fork drive solenoid 154 or the fifth fork drive solenoid 155 and the unacceptable bill collecting fork 120, the first fork 121, the second fork 122, the third fork 123, the fourth fork 124 or the fifth fork 125 is selectively driven, whereby the bills B are sorted and accommodated in the unacceptable bill collecting box 140, the first bill accommodating box 141, the second bill accommodating box 142, the third bill accommodating box 143, the fourth bill accommodating box 144, the fifth bill accommodating box 145 and the bill collecting box 146.

More specifically, in the case where three denomination of bills B are sorted, unacceptable bills B such as counterfeit bills B, foreign bills B and the like are accommodated in the unacceptable bill collecting box 140, acceptable but damaged bills B the damage level of which is not lower than a predetermined level are accommodated in the bill collecting box 146 and acceptable and undamaged bills B are accommodated in the first bill accommodating box 141, the second bill accommodating box 142 and the third bill accommodating box 143 in accordance with their denominations. When the number N of bills B accommodated in any of the first bill accommodating box 141, the second bill accommodating box 142 and the third bill accommodating box 143 reaches the predetermined number $N_0$, the bills B of the denomination to be accommodated in the bill accommodating box containing the predetermined number $N_0$ of bills B are first accommodated in the fourth bill accommodating box 144. Further, when the number N of bills B accommodated in any of the first bill accommodating box 141, the second bill accommodating box 142, the third bill accommodating box 143 and the fourth bill accommodating box 144 reaches the predetermined number $N_0$, the bills B of the denomination to be accommodated in the bill accommodating box containing the predetermined number $N_0$ of bills B are accommodated in the fifth bill accommodating box 145. Then, when the fourth bill accommodating box 144 and the fifth bill accommodating box 145 cannot accommodate a bill B which cannot be accommodated in any of the first bill accommodating box 141, the second bill accommodating box 142 and the third bill accommodating box 143, the bill sorting operation is stopped.

According to this embodiment, even in the case where bills B deposited into the bill receiving machine generally include a lot of bills B of a specific denomination and the bill B of the denomination cannot be accommodated in the bill accommodating box which has been accommodating the bills B of the denomination, since the bills B of the denomination can be accommodated in another bill accommodating box, it is possible to prevent the sorting operation from being stopped, thereby enabling efficient sorting of bills B. Further, in the case where the second sorting mode is selected, it is possible to automatically sort out damaged bills B from undamaged bills B.

According to the present invention, it is possible to provide a currency sorting apparatus which can efficiently sort pieces of currency even when the pieces of currency deposited into the currency handling machine include a lot of pieces of currency of a specific denomination.

The present invention has thus been shown and described with reference to specific embodiments. However, it should be noted that the present invention is in no way limited to the details of the described arrangements but changes and modifications may be made without departing from the scope of the appended claims.

For example, the embodiments shown in FIGS. 1 to 8 and FIGS. 9 to 13 are provided with the first coin number detecting means 71, the second coin number detecting means 72, the third coin number detecting means 73, the fourth coin number detecting means 74 and the fifth coin number detecting means 75 and when any of them detects that the number N of coins C accommodated in the corresponding coin accommodating box has reached the predetermined number $N_0$, it outputs an accommodation stop signal to the CPU 60. The embodiment shown in FIGS. 14 and 15 is provided with the first bill number detecting means 161, the second bill number detecting means 162, the third bill number detecting means 163, the fourth bill number detecting means 164 and the fifth bill number detecting means 165 and when any of them detects that the number N of bills B accommodated in the corresponding bill accommodating box has reached the predetermined number $N_0$, it outputs an accommodation stop signal to the CPU 60. However, it is possible to judge whether or not the number of coins C accommodated in any coin accommodating box or the number of bills B accommodated in any bill accommodating box has reached the predetermined number $N_0$ by causing the CPU 60 to store count values in the counter provided in the RAM 62 based on the detection signals from the magnetic sensor 6 or 103 and the optical sensor 7 or 104 and to read them out. On the contrary, a coin number detecting means may be provided for the unacceptable coin accommodating box 30 and/or the coin collecting box 36, or a bill number detecting means may be provided for the unacceptable bill collecting box 140 and/or the bill collecting box 146.

Further, in the embodiment shown in FIGS. 1 to 8, each of the unacceptable coin collecting opening 20, the first coin sorting opening 21, the second coin sorting opening 22, the third coin sorting opening 23, the fourth coin sorting opening 24 and the fifth coin sorting opening 25 is formed so that its length in the widthwise direction of the coin sorting passage 10 is smaller than the diameter of the smallest coin to be handled and that the coin C can pass thereon. Instead, the size of the opening may be made sufficiently large for dropping the largest coin to be handled and the unacceptable coin collecting opening 20, the first coin sorting opening 21, the second coin sorting opening 22, the third coin sorting opening 23, the fourth coin sorting opening 24 and the fifth coin sorting opening 25 may be arranged so that when the coin C is being transported along the reference guide wall 14, it cannot fall into the unacceptable coin collecting opening 20, the first coin sorting opening 21, the second coin sorting opening 22, the third coin sorting opening 23, the fourth coin sorting opening 24 or the fifth coin sorting opening 25 and that when the unacceptable coin collecting means 40, the first sorting means 41, the second sorting means 42, the third sorting means 43, the fourth sorting means 44 or the fifth sorting means is rotated, the coin C is dropped in the unacceptable coin collecting opening 20, the first coin sorting opening 21, the second coin sorting opening 22, the third coin sorting opening 23, the fourth coin sorting opening 24 or the fifth coin sorting opening 25.

Moreover, in the embodiments shown in FIGS. 1 to 8 and FIGS. 9 to 13, although the unacceptable coin collecting opening 20 and the unacceptable coin collecting box are provided for collecting unacceptable coins C such as counterfeit coins C, foreign coins C and the like, the unacceptable coins C may be immediately returned to the outside of the coin receiving machine without being collected in the machine. Similarly, in the embodiment shown in FIGS. 14 and 15, although the unacceptable bill collecting fork 120 and the unacceptable bill collecting box 140 are provided for collecting unacceptable bills B such as counterfeit bills B, foreign bills B and the like, the unacceptable bills B may be immediately returned to the outside of the bill receiving machine without being collected in the machine.

Further, in the embodiment shown in FIGS. 1 to 8, although the unacceptable coin collecting means 40, the first sorting means 41, the second sorting means 42, the third sorting means 43, the fourth sorting means 44 and the fifth sorting means 45 are in the form of a semicylinder, they may be in any other forms, such as an arm, insofar as they can push coins C away from the reference guide wall 14.

Furthermore, in the embodiment shown in FIGS. 9 to 13, although each of the unacceptable coin collecting drum 90, the first sorting drum 91, the second sorting drum 92, the third sorting drum 93, the fourth sorting drum 94 and the fifth sorting drum 95 is formed by cutting away a part of the side portion of the cylinder along a plane parallel to the axis thereof, it is sufficient for it to enable the coin C to pass on the corresponding opening when no drive signal is output to the corresponding solenoid and to enable the coin C to fall into the corresponding opening along the side surface thereof when a drive signal is output to the corresponding solenoid and it is rotated. Therefore, each of the unacceptable coin collecting drum 90, the first sorting drum 91, the second sorting drum 92, the third sorting drum 93, the fourth sorting drum 94 and the fifth sorting drum 95 may be constituted as a rotor having a large diameter portion and a small diameter portion and arranged such that when no drive signal is output to the corresponding solenoid, it is held so that the level of the top portion of the large diameter portion is substantially the same as that of the surface of the coin sorting passage 10, whereas when a drive signal is output to the corresponding solenoid, it is be rotated so that the level of the top portion of the large diameter portion is lower than that of the surface of the coin sorting passage 10.

Moreover, in the embodiment shown in FIGS. 1 to 8, although no sorting means or collecting means is provided for the coin collecting opening 26, whereas the unacceptable coin collecting means 40, the first sorting means 41, the second sorting means 42, the third sorting means 43, the fourth sorting means 44 and the fifth sorting means 45 are provided for the unacceptable coin collecting opening 20, the first sorting opening 21, the second sorting opening 22, the third sorting opening 23, the fourth sorting opening 24 and the fifth sorting opening 25 respectively, a sorting means or collecting means may also be provided for the coin collecting opening 26. If such a sorting means or collecting means is provided for the coin collecting opening 26, when the second sorting mode is selected, damaged coins C can be accommodated in either of the unacceptable coin collecting box 30, the first coin accommodating box 31, the second coin accommodating box 32, the third coin accommodating box 33, the fourth coin accommodating box 34 and the fifth coin accommodating box 35 and undamaged coins C of a specific denomination can be selectively accommodated in the coin collecting box 36. Further, in the embodiment shown in FIGS. 9 to 13, although no sorting drum or collecting drum is provided for the coin collecting opening 26, whereas the unacceptable coin collecting drum 90, the first sorting drum 91, the second sorting drum 92, the third sorting drum 93, the fourth sorting drum 94 and the fifth sorting drum 95 are provided for the unacceptable coin collecting opening 20, the first sorting opening 21, the second sorting opening 22, the third sorting opening 23, the fourth sorting opening 24 and the fifth sorting opening 25 respectively, a sorting drum or collecting drum may also be provided for the coin collecting opening 26. If such a sorting drum or collecting drum is provided for the coin collecting opening 26, when the second sorting mode is selected, damaged coins C can be accommodated in either of the unacceptable coin collecting box 30, the first coin accommodating box 31, the second coin accommodating box 32, the third coin accommodating box 33, the fourth coin accommodating box 34 and the fifth coin accommodating box 35 and undamaged coins C of a specific denomination can be selectively accommodated in the coin collecting box 36. Similarly, in the embodiment shown in FIGS. 14 and 15, although no fork is provided for the bill collecting box 146, whereas the unacceptable bill collecting fork 120, the first fork 121, the second fork 122, the third fork 123, the fourth fork 124 and the fifth fork 125 are provided for the unacceptable bill collecting box 140, the first bill accommodating box 141, the second bill accommodating box 142, the third bill accommodating box 143, the fourth bill accommodating box 144 and the fifth bill accommodating box 145, such a fork may also be provided for the bill collecting box 146. If such a fork is provided for the bill collecting box 146, when the second sorting mode is selected, damaged bills B can be accommodated in either of the unacceptable bill collecting box 140, the first bill accommodating box 141, the second bill accommodating box 142, the third bill accommodating box 143, the fourth bill accommodating box 144 and the fifth bill accommodating box 145 and undamaged bills B of a specific denomination can be selectively accommodated in the bill collecting box 146.

Further, in the above described embodiments, although the unacceptable coin collecting box 30 or the unacceptable bill collecting box 140 is disposed at the most upstream portion in the coin sorting passage 10 or the bill sorting passage 115, the position of the unacceptable coin collecting box 30 or the unacceptable bill collecting box 140 may be determined arbitrarily.

Furthermore, in the embodiments shown in FIGS. 1 to 13, although acceptable coins C are successively accommodated in the first coin accommodating box 31, the second coin accommodating box 32, the third coin accommodating box 33, the fourth coin accommodating box 34 and the fifth coin accommodating box 35, the acceptable coin C first sorted may be accommodated in any other coin accommodating box than the first coin accommodating box 31. Similarly, in the embodiment shown in FIGS. 14 and 15, the acceptable bill B first sorted may be accommodated in any other bill accommodating box than the first bill accommodating box 141.

Moreover, in the above described embodiments, although seven boxes are provided for accommodating or collecting coins C or bills B, the number of the boxes is not limited to seven and it is sufficient for the boxes to be provided in a greater than the number of denominations of coins C or bills B to be sorted.

Further, in the present invention, the respective means need not be physical means and arrangements whereby the functions of the respective means are accomplished by software fall within the scope of the present invention. In addition, the functions of two or more means may be accomplished by a single physical means and the function of a single means may be accomplished by two or more physical means.

We claim:

1. A currency sorting apparatus comprising currency feed-out means for receiving pieces of currency and feeding out the pieces of currency to a currency passage one by one, transporting means provided in the currency passage for transporting the pieces of currency fed to the currency passage, currency detecting means provided in the currency passage for detecting information necessary for discriminating at least whether the pieces of currency are acceptable and the denominations of the pieces of currency and outputting detection signals, a plurality of currency accommodating means provided in the currency passage downstream of the currency detecting means, the number of which is greater than the number of denominations of the pieces of currency to be sorted, each of the currency accommodating means being adapted for accommodating acceptable pieces of currency in accordance with their denominations, a plurality of currency distributing means, each being provided so as to correspond to one of the plurality of currency accommodating means and adapted for feeding the pieces of currency into the corresponding currency accommodating means, control means adapted for selectively driving the currency distributing means in accordance with the detection signals input from the currency detecting means and sorting mode selection means which can be operated by an operator for selecting a sorting mode which determines what currency accommodating means accommodates what denomination of pieces of currency and outputs a corresponding sorting mode signal when the sorting mode is selected, the currency sorting apparatus being constituted so that in the case where a first automatic sorting mode is selected in the sorting mode selection means, the control means judges based on the detection signals from the currency detecting means whether or not one of the currency accommodating means has accommodated a piece of currency of the same denomination as that of the piece of currency to be sorted and when it judges that there is a currency accommodating means which has accommodated a piece of currency of the same denomination as that of the piece of currency to be sorted, it selectively drives the corresponding currency distributing means so as to accommodate the piece of currency in the currency accommodating means which has accommodated the piece of currency of the same denomination as that of the piece of currency to be sorted, whereas it selectively drives the currency distributing means corresponding to the currency accommodating means which has not accommodated any piece of currency so as to accommodate the piece of currency therein when there is no currency accommodating means which has accommodated a piece of currency of the same denomination as that of the piece of currency to be sorted, and when the number of pieces of currency accommodated in one of the currency accommodating means has reached a predetermined number, it selectively drives the currency distributing means corresponding to the currency accommodating means which has not accommodated any piece of currency so as to accommodate the piece of currency the denomination of which is the same as that of the pieces of currency accommodated in the currency accommodating means in which the number of pieces of currency has reached the predetermined number in the currency accommodating means which has not accommodated any piece of currency.

2. A currency sorting apparatus in accordance with claim 1 wherein the currency detecting means is adapted for detecting information necessary for discriminating whether pieces of currency are acceptable, the denominations and damage levels of pieces of currency and outputting the detection signal and the currency accommodating means are provided so that the number thereof is greater than the number of denominations of the pieces of currency to be sorted by two or more and in the case where a second sorting mode is selected in the sorting mode selection means, the control means judges based on the detection signals from the currency detecting means whether or not a damage level of the piece of currency is lower than a predetermined level and when it judges that the damage level of the piece of currency is not lower than the predetermined level, it selectively drives a currency distributing means corresponding to a particular currency accommodating means among the plurality of the currency accommodating means so as to accommodate the piece of currency the damage level of which is judged not lower than the predetermined level in the particular currency accommodating means, and when the control means judges that the damaged level of the piece of currency is lower than the predetermined level, it judges whether or not one of the currency accommodating means has accommodated the piece of currency of the same denomination as that of the piece of currency to be sorted and when it judges that there is a currency accommodating means which has accommodated a piece of currency of the same denomination as that of the piece of currency to be sorted, it selectively drives the corresponding currency distributing means so as to accommodate the piece of currency in the currency accommodating means which has accommodated the piece of currency of the same denomination as that of the piece of currency to be sorted, whereas it selectively drives the currency distributing means corresponding to the currency accommodating means which has not accommodated any piece of currency so as to accommodate the piece of currency therein when there is no currency accommodating means which has accommodated a piece of currency of the same denomination as that of the piece of currency to be sorted, and when the number of pieces of currency accommodated in one of the currency accommodating means has reached a predetermined number, it selectively drives the currency distributing means corresponding to the currency accommodating means which has not accommodated any currency so as to accommodate the piece of currency the denomination of which is the same as that of the pieces of currency accommodated in the currency accommodating means in which the number of pieces of currency has reached the predetermined number in the currency accommodating means which has not accommodated any piece of currency.

3. A currency sorting apparatus in accordance with claim 1 which further comprises a damaged currency accommodating means for accommodating damaged pieces of currency the damage level of which is not lower than a predetermined level, a damaged currency distributing means for feeding the damaged pieces of currency into the damaged currency accommodating means and a currency detecting means adapted for detecting information necessary for discriminating whether pieces of currency are acceptable, the denominations of pieces of currency and damaged levels and outputting a detection signal and in the case where a second sorting mode is selected in the sorting mode selection means, the control means judges based on the detection signals from the currency detecting means whether or not a damage level of the piece of currency is lower than a predetermined level and when it judges that the damage level of the piece of currency is not lower than the predetermined level, it selectively drives the damaged currency distributing means so as to accommodate the damaged piece of currency in the damaged currency accommodating means.

4. A currency sorting apparatus in accordance with claim 1 which further comprises an unacceptable currency accommodating means for accommodating unacceptable pieces of currency and an unacceptable currency distributing means for feeding the unacceptable pieces of currencies into the unacceptable currency accommodating means and the control means is constituted so that when it judges based on the detection signal from the currency detecting means that the piece of currency is unacceptable, it selectively drives the unacceptable currency distributing means thereby accommodating the unacceptable piece of currency in the unacceptable currency accommodating means.

5. A currency sorting apparatus in accordance with claim 2 which further comprises an unacceptable currency accommodating means for accommodating unacceptable pieces of currency and an unacceptable currency distributing means for feeding the unacceptable pieces of currencies into the unacceptable currency accommodating means and the control means is constituted so that when it judges based on the detection signal from the currency detecting means that the piece of currency is unacceptable, it selectively drives the unacceptable currency distributing means thereby accommodating the unacceptable piece of currency in the unacceptable currency accommodating means.

6. A currency sorting apparatus in accordance with claim 3 which further comprises an unacceptable currency accommodating means for accommodating unacceptable pieces of currency and an unacceptable currency distributing means for feeding the unacceptable pieces of currencies into the unacceptable currency accommodating means and the control means is constituted so that when it judges based on the detection signal from the currency detecting means that the piece of currency is unacceptable, it selectively drives the unacceptable currency distributing means thereby accommodating the unacceptable piece of currency in the unacceptable currency accommodating means.

7. A currency sorting apparatus in accordance with claim 1 wherein the pieces of currency are coins and each of the plurality of currency accommodating means comprises a coin dropping opening which opens the currency passage and a coin accommodating box communicating with the coin dropping opening and each of the plurality of currency distributing means comprises a rotor supported below the currency passage to be rotatable about a shaft arranged parallel to a surface of the currency passage and perpendicular to a direction of the currency passage and having a large diameter portion and a small diameter portion and a rotor drive means for rotating the rotor, the rotor being held so that a level of a top portion of the large diameter portion is substantially flush with a level of the currency passage surface when the control means is not actuating the currency distributing means, whereas the rotor is rotated by the rotor drive means so that the level of the top portion of the large diameter portion is lower than the level of the currency passage surface when the control means is actuating the currency distributing means.

8. A currency sorting apparatus in accordance with claim 2 wherein the pieces of currency are coins and each of the plurality of currency accommodating means comprises a coin dropping opening which opens the currency passage and a coin accommodating box communicating with the coin dropping opening and each of the plurality of currency distributing means comprises a rotor supported below the currency passage to be rotatable about a shaft arranged parallel to a surface of the currency passage and perpendicular to a direction of the currency passage and having a large diameter portion and a small diameter portion and a rotor drive means for rotating the rotor, the rotor being held so that a level of a top portion of the large diameter portion is substantially flush with a level of the currency passage surface when the control means is not actuating the currency distributing means, whereas the rotor is rotated by the rotor drive means so that the level of the top portion of the large diameter portion is lower than the level of the currency passage surface when the control means is actuating the currency distributing means.

9. A currency sorting apparatus in accordance with claim 3 wherein the pieces of currency are coins and each of the plurality of currency accommodating means comprises a coin dropping opening which opens the currency passage and a coin accommodating box communicating with the coin dropping opening and each of the plurality of currency distributing means comprises a rotor supported below the currency passage to be rotatable about a shaft arranged parallel to a surface of the currency passage and perpendicular to a direction of the currency passage and having a large diameter portion and a small diameter portion and a rotor drive means for rotating the rotor, the rotor being held so that a level of a top portion of the large diameter portion is substantially flush with a level of the currency passage surface when the control means is not actuating the currency distributing means, whereas the rotor is rotated by the rotor drive means so that the level of the top portion of the large diameter portion is lower than the level of the currency passage surface when the control means is actuating the currency distributing means.

10. A currency sorting apparatus in accordance with claim 4 wherein the pieces of currency are coins and each of the plurality of currency accommodating means comprises a coin dropping opening which opens the currency passage and a coin accommodating box communicating with the coin dropping opening and each of the plurality of currency distributing means comprises a rotor supported below the currency passage to be rotatable about a shaft arranged parallel to a surface of the currency passage and perpendicular to a direction of the currency passage and having a large diameter portion and a small diameter portion and a rotor drive means for rotating the rotor, the rotor being held so that a level of a top portion of the large diameter portion is substantially flush with a level of the currency passage surface when the control means is not actuating the currency distributing means, whereas the rotor is rotated by the rotor drive means so that the level of the top portion of the large diameter portion is lower than the level of the currency passage surface when the control means is actuating the currency distributing means.

11. A currency sorting apparatus in accordance with claim 5 wherein the pieces of currency are coins and each of the plurality of currency accommodating means comprises a coin dropping opening which opens the currency passage and a coin accommodating box communicating with the coin dropping opening and each of the plurality of currency distributing means comprises a rotor supported below the currency passage to be rotatable about a shaft arranged parallel to a surface of the currency passage and perpendicular to a direction of the currency passage and having a large diameter portion and a small diameter portion and a rotor drive means for rotating the rotor, the rotor being held so that a level of a top portion of the large diameter portion is substantially flush with a level of the currency passage surface when the control means is not actuating the currency distributing means, whereas the rotor is rotated by the rotor drive means so that the level of the top portion of the large diameter portion is lower than the level of the currency passage surface when the control means is actuating the currency distributing means.

12. A currency sorting apparatus in accordance with claim 6 wherein the pieces of currency are coins and each of the plurality of currency accommodating means comprises a coin dropping opening which opens the currency passage and a coin accommodating box communicating with the coin dropping opening and each of the plurality of currency distributing means comprises a rotor supported below the currency passage to be rotatable about a shaft arranged parallel to a surface of the currency passage and perpendicular to a direction of the currency passage and having a large diameter portion and a small diameter portion and a rotor drive means for rotating the rotor, the rotor being held so that a level of a top portion of the large diameter portion is substantially flush with a level of the currency passage surface when the control means is not actuating the currency distributing means, whereas the rotor is rotated by the rotor drive means so that the level of the top portion of the large diameter portion is lower than the level of the currency passage surface when the control means is actuating the currency distributing means.

* * * * *